US009919173B2

(12) United States Patent
Blau et al.

(10) Patent No.: US 9,919,173 B2
(45) **Date of Patent: *Mar. 20, 2018**

(54) MAN-RATED FIRE SUPPRESSION SYSTEM AND RELATED METHODS

(71) Applicant: Orbital ATK, Inc., Dulles, VA (US)

(72) Inventors: Reed J. Blau, Richmond, UT (US); James D. Rozanski, Brigham City, UT (US); Richard M. Truitt, Champlin, MN (US); Gary K. Lund, Malad, ID (US); William P. Sampson, North Ogden, UT (US)

(73) Assignee: Orbital ATK, Inc., Plymouth, MN (US)

( * ) Notice: Subject to any disclaimer, the term of this patent is extended or adjusted under 35 U.S.C. 154(b) by 494 days.

This patent is subject to a terminal disclaimer.

(21) Appl. No.: 13/792,903

(22) Filed: Mar. 11, 2013

(65) Prior Publication Data

US 2013/0175059 A1 Jul. 11, 2013

Related U.S. Application Data

(63) Continuation of application No. 11/409,257, filed on Apr. 21, 2006, now Pat. No. 8,408,322, which is a (Continued)

(51) Int. Cl.
*A62C 11/00* (2006.01)
*A62C 99/00* (2010.01)
(Continued)

(52) U.S. Cl.
CPC ..... *A62C 99/0018* (2013.01); *A62C 5/006* (2013.01); *A62C 13/22* (2013.01); *A62D 1/06* (2013.01)

(58) Field of Classification Search
CPC ..... A62C 2/00; A62C 2/242; A62C 3/002; A62C 3/08; A62C 3/10; A62C 35/00
(Continued)

(56) References Cited

U.S. PATENT DOCUMENTS 1,839,658 A 1/1932 Dugas
2,744,816 A 5/1956 Hutchison
(Continued)

FOREIGN PATENT DOCUMENTS

CN 2661989 Y 12/2004
CN 1695750 A 11/2005
(Continued)

OTHER PUBLICATIONS

Annex to Form PCT/ISA/206, Communication Relating to the Results of the Partial International Search, dated Jun. 24, 2005.
(Continued)

*Primary Examiner* — Davis Hwu
(74) *Attorney, Agent, or Firm* — TraskBritt

(57) ABSTRACT

A fire suppression system for producing an inert gas mixture having a minimal amount of carbon monoxide, particulates, or smoke. The inert gas mixture may be generated by combusting a gas generant. The gas generant may be a composition that includes hexa(ammine)-cobalt(III)-nitrate. The fire suppression system also includes a heat management system to reduce a temperature of the inert gas mixture. In one embodiment, the system includes multiple gas generators and is configured to ignite the respective gas generant of each gas generator in a predetermined, time based sequential order. For example, the gas generant of each gas generator may be ignited in a sequential order at specified time intervals. Methods of extinguishing fires are also disclosed.

32 Claims, 11 Drawing Sheets

Related U.S. Application Data continuation-in-part of application No. 10/727,088, filed on Dec. 2, 2003, now abandoned.

(51) Int. Cl.
*A62D 1/06* (2006.01)
*A62C 5/00* (2006.01)
*A62C 13/22* (2006.01)

(58) Field of Classification Search
USPC .... 169/9, 11, 12, 43, 46, 47, 84; 239/67, 70
See application file for complete search history.

(56) References Cited

U.S. PATENT DOCUMENTS 2,841,227 A 7/1958 Betzler
3,255,824 A 6/1966 Rodgers
3,524,506 A 8/1970 Weise
3,641,935 A 2/1972 Gawlick et al.
3,701,256 A 10/1972 Pelham et al.
3,741,585 A 6/1973 Hendrickson et al.
3,806,461 A 4/1974 Hendrickson et al.
3,836,076 A 9/1974 Conrad et al.
3,889,757 A 6/1975 Dunn
3,972,545 A 8/1976 Kirchoff et al.
3,972,820 A 8/1976 Filter
4,064,944 A 12/1977 McClure
4,067,392 A 1/1978 Rich
4,113,019 A 9/1978 Sobolev et al.
4,224,994 A 9/1980 Tone et al.
4,448,577 A 5/1984 Paczkowski
4,505,336 A 3/1985 Thevis et al.
4,601,344 A 7/1986 Reed et al.
4,616,694 A 10/1986 Hsieh
4,807,706 A 2/1989 Lambertsen et al.
4,817,828 A 4/1989 Goetz
4,890,860 A 1/1990 Schneiter
4,909,549 A 3/1990 Poole
4,931,111 A 6/1990 Poole
4,998,751 A 3/1991 Paxton et al.
5,035,757 A 7/1991 Poole
5,038,866 A 8/1991 Kern et al.
5,039,347 A 8/1991 Hindstrom et al.
5,060,867 A 10/1991 Luxton et al.
5,109,772 A 5/1992 Cunningham et al.
5,172,445 A 12/1992 Chandler
5,197,758 A 3/1993 Lund et al.
5,423,384 A 6/1995 Galbraith et al.
5,425,886 A 6/1995 Smith
5,429,691 A 7/1995 Hinshaw et al.
5,439,537 A 8/1995 Hinshaw et al.
5,441,114 A 8/1995 Spector et al.
5,449,041 A 9/1995 Galbraith
5,465,795 A 11/1995 Galbraith et al.
5,495,893 A 3/1996 Roberts et al.
5,520,826 A 5/1996 Reed
5,531,941 A 7/1996 Poole
5,538,568 A 7/1996 Taylor et al.
5,542,704 A 8/1996 Hamilton et al.
5,544,687 A 8/1996 Barnes et al.
5,588,493 A 12/1996 Spector et al.
5,609,210 A 3/1997 Galbraith et al.
5,610,359 A 3/1997 Spector et al.
5,613,562 A 3/1997 Galbraith et al.
5,660,236 A 8/1997 Sears et al.
5,673,935 A 10/1997 Hinshaw et al.
5,712,445 A 1/1998 Kassuelke et al.
5,725,699 A 3/1998 Hinshaw et al.
5,735,118 A 4/1998 Hlinshaw et al.
5,739,460 A 4/1998 Knowlton et al.
5,762,145 A 6/1998 Bennett
5,772,243 A 6/1998 Green et al.
5,783,773 A 7/1998 Poole et al.
5,820,160 A 10/1998 Johnson et al.
5,845,716 A 12/1998 Birk
5,845,933 A 12/1998 Walker et al.
5,848,652 A 12/1998 Bennett
5,861,106 A 1/1999 Olander
5,865,257 A 2/1999 Kozyrev et al.
5,876,062 A 3/1999 Hock
5,882,036 A 3/1999 Moore et al.
5,884,710 A 3/1999 Barnes et al.
5,918,679 A 7/1999 Cramer
5,957,210 A 9/1999 Cohrt et al.
5,985,060 A 11/1999 Cabrera et al.
5,992,528 A 11/1999 Parkinson et al.
5,992,530 A 11/1999 Sundholm
5,992,881 A 11/1999 Faigle
5,996,699 A 12/1999 Sundholm
6,012,533 A 1/2000 Cramer
6,016,874 A 1/2000 Bennett
6,019,177 A 2/2000 Olander
6,019,861 A 2/2000 Canterberry et al.
6,024,889 A 2/2000 Holland et al.
6,039,820 A 3/2000 Hinshaw et al.
6,045,637 A 4/2000 Grzyll
6,045,638 A 4/2000 Lundstrom
6,065,774 A 5/2000 Cabrera
6,076,468 A 6/2000 DiGiacomo et al.
6,077,372 A 6/2000 Mendenhall et al.
6,082,464 A 7/2000 Mitchell et al.
6,086,693 A 7/2000 Mendenhall et al.
6,089,326 A 7/2000 Drakin
6,093,269 A 7/2000 Lundstrom
6,095,559 A 8/2000 Smith et al.
6,096,147 A 8/2000 Taylor et al.
6,116,348 A 9/2000 Drakin
6,123,359 A 9/2000 Cabrera et al.
6,132,480 A 10/2000 Barnes et al.
6,136,114 A 10/2000 Johnson et al.
6,143,104 A 11/2000 Blomquist
6,149,193 A * 11/2000 Canterberry et al. ..... 280/741
6,164,383 A 12/2000 Thomas
6,196,583 B1 3/2001 Ruckdeschel et al.
6,202,755 B1 3/2001 Hardge
6,217,788 B1 4/2001 Wucherer et al.
6,224,099 B1 5/2001 Nielson et al.
6,250,072 B1 6/2001 Jacobson et al.
6,257,341 B1 7/2001 Bennett
6,287,400 B1 9/2001 Burns et al.
6,314,754 B1 11/2001 Kotliar
6,328,906 B1 12/2001 Lundstrom et al.
6,334,315 B1 1/2002 Kotliar
6,357,355 B1 3/2002 Fogle, Jr.
6,371,213 B1 4/2002 Smith et al.
6,371,384 B1 4/2002 Garcia
6,401,487 B1 6/2002 Kotliar
6,416,599 B1 7/2002 Yoshikawa et al.
6,418,752 B2 7/2002 Kotliar
6,435,552 B1 8/2002 Lundstrom et al.
6,474,684 B1 11/2002 Ludwig et al.
6,481,746 B1 11/2002 Hinshaw et al.
6,481,748 B1 11/2002 Okuda et al.
6,502,421 B2 1/2003 Kotliar
6,513,602 B1 2/2003 Lewis et al.
6,557,374 B2 5/2003 Kotliar
6,560,991 B1 5/2003 Kotliar
6,599,380 B2 7/2003 Zeuner et al.
6,601,653 B2 8/2003 Grabow et al.
6,605,233 B2 8/2003 Knowlton et al.
6,612,243 B1 9/2003 Italiane et al.
6,634,433 B2 10/2003 Kim et al.
6,739,399 B2 5/2004 Wagner et al.
6,851,483 B2 2/2005 Olander et al.
6,935,433 B2 8/2005 Gupta
6,942,249 B2 9/2005 Iwai et al.
6,981,555 B2 1/2006 Smith et al.
6,990,905 B1 1/2006 Manole et al.
7,028,782 B2 4/2006 Richardson
7,059,633 B2 6/2006 Wang et al.
7,073,820 B2 7/2006 McCormick
7,156,184 B2 1/2007 Wagner
7,337,856 B2 3/2008 Lund et al.
7,451,829 B2 11/2008 Thompson

(56) References Cited

U.S. PATENT DOCUMENTS

| | | | |
|---|---|---|---|
| 7,455,119 | B2 | 11/2008 | Thompson |
| 7,455,120 | B2 | 11/2008 | Richardson et al. |
| 7,597,153 | B2 | 10/2009 | Thompson |
| 7,770,924 | B2 | 8/2010 | Cox et al. |
| 7,845,423 | B2 | 12/2010 | Lund et al. |
| 7,887,091 | B1 | 2/2011 | Cox et al. |
| 8,047,569 | B2 | 11/2011 | Cox et al. |
| 8,162,350 | B1 | 4/2012 | Parkinson et al. |
| 8,808,476 | B2 | 8/2014 | Mendenhall et al. |
| 8,939,225 | B2 | 1/2015 | Cox et al. |
| 2002/0007886 | A1 | 1/2002 | Neidert et al. |
| 2002/0020536 | A1 | 2/2002 | Bennett |
| 2002/0137875 | A1 | 9/2002 | Reed et al. |
| 2002/0195181 | A1 | 12/2002 | Lundstrom |
| 2003/0222445 | A1 | 12/2003 | Patterson |
| 2004/0089383 | A1 | 5/2004 | Mendenhall et al. |
| 2004/0089460 | A1 | 5/2004 | Richardson |
| 2004/0145166 | A1 | 7/2004 | Smith |
| 2004/0173922 | A1 | 9/2004 | Barnes |
| 2005/0081419 | A1 | 4/2005 | Fleischhauer et al. |
| 2005/0115721 | A1 | 6/2005 | Blau et al. |
| 2005/0139365 | A1 | 6/2005 | Richardson et al. |
| 2005/0189123 | A1 | 9/2005 | Richardson et al. |
| 2005/0235863 | A1 | 10/2005 | Stevens |
| 2005/0257866 | A1 | 11/2005 | Williams et al. |
| 2006/0278409 | A1 | 12/2006 | Blau et al. |
| 2008/0128145 | A1 | 6/2008 | Butz et al. |
| 2010/0013201 | A1 | 1/2010 | Cox et al. |
| 2010/0116384 | A1 | 5/2010 | Mendenhall et al. |
| 2010/0170684 | A1 | 7/2010 | Richardson et al. |
| 2010/0194085 | A1 | 8/2010 | Mayville et al. |
| 2010/0230942 | A1 | 9/2010 | Rose |
| 2010/0307775 | A1 | 12/2010 | Robbins et al. |
| 2011/0101662 | A1 | 5/2011 | Rose et al. |
| 2011/0226493 | A1 | 9/2011 | Blau et al. |
| 2012/0085556 | A1 | 4/2012 | Cox et al. |

FOREIGN PATENT DOCUMENTS

| | | | |
|---|---|---|---|
| CN | 101700427 | A | 5/2010 |
| CN | 101915311 | A | 12/2010 |
| CN | 201871153 | U | 6/2011 |
| CN | 103153401 | A | 6/2013 |
| DE | 19546528 | A1 | 6/1997 |
| DE | 19602695 | | 7/1997 |
| DE | 19717044 | A1 | 10/1997 |
| EP | 00009346 | A1 | 8/1979 |
| EP | 0784998 | A2 | 7/1997 |
| EP | 0792777 | A1 | 9/1997 |
| EP | 0804945 | A2 | 11/1997 |
| EP | 0956883 | A1 | 11/1999 |
| EP | 1767248 | A1 | 3/2007 |
| GB | 1219363 | A | 1/1971 |
| JP | 5248640 | A | 11/1977 |
| JP | 07237520 | A | 9/1995 |
| JP | 3031800 | U | 12/1996 |
| JP | 09500296 | A | 1/1997 |
| JP | 2001276273 | | 10/2001 |
| JP | 2001518046 | A | 10/2001 |
| JP | 2001346898 | A | 12/2001 |
| JP | 2002160992 | A | 6/2002 |
| JP | 2002291939 | | 10/2002 |
| JP | 2004321272 | | 11/2004 |
| JP | 2007252731 | | 10/2007 |
| JP | 2007528322 | T | 10/2007 |
| JP | 2009072594 | | 4/2009 |
| JP | 2011116229 | A | 6/2011 |
| WO | 9315793 | A1 | 8/1993 |
| WO | 9500205 | A1 | 1/1995 |
| WO | 9846529 | A1 | 10/1998 |
| WO | 9901180 | A2 | 1/1999 |
| WO | 0006424 | A1 | 2/2000 |
| WO | 0015305 | A1 | 3/2000 |
| WO | 03024534 | A1 | 3/2003 |
| WO | 2004028642 | A1 | 4/2004 |
| WO | 2004091729 | A1 | 10/2004 |
| WO | 2005039893 | A2 | 5/2005 |
| WO | 2008034805 | A1 | 3/2008 |
| WO | 2008140441 | | 11/2008 |
| WO | 2009050443 | A2 | 4/2009 |

OTHER PUBLICATIONS

Berezovsky, "Pyrogen, A Revolution in Fire Suppression Technology?", Fire Safety Engineering, vol. 5, No. 5, Oct. 1998, pp. 30-32.

Ebeling, Hans, et al., "Development of Gas Generators for Fire Extinguishing," Propellants, Explosives, Pyrotechnics, vol. 22, pp. 170-175, 1997.

Engelen, K., et al., "Pyrotechnic Propellant for Nitrogen Gas Generator," Bull. Soc. Chim Belg., vol. 106, No. 6, pp. 349-354, 1997.

Fallis, Stephen, et al., "Advanced Propellant/Additive Development for Fire Suppressing Gas Generators: Development + Test," Proceedings of HOTWC-2002 12th Halon Options Technical Working Conference, Albuquerque, NM, Apr. 20-May 2, 2002, National Institute of Standards and Technology Special Publication 984.

Fletcher M., "Fighting Fire with Fire," Eureka (Inc. Engineering Materials and Design), Findlay Publications, Horton Kirby, Kent, GB, vol. 20, No. 1, Jan. 2000, p. 17, XP000877927, ISSN: 0261-2097 (Downloaded online version).

Mitchell, Robert M., Olin Aerospace Company, Report on Advanced Fire Suppression Technology (AFST) Research and Development Program, 52 pages, Report Date Sep. 1994.

Palaszewski, Bryan A., NASA Glenn Research Center, Safer Aircraft Possible with Nitrogen Generation, 2 pages, Mar. 2001.

PCT International Preliminary Examination Report, for PCT/CA 03/01525, dated Jan. 17, 2005, 10 pages.

PCT International Search Report for PCT/US2004/040258, dated Mar. 17, 2005, 3 pages.

PCT International Search Report for PCT/US2004/040248, dated Nov. 23, 2006, 6 pages.

Saito, Naoshi, et al., "Flame-extinguishing Concentrations and Peak Concentrations of N2, Ar, Cot and their Mixtures for Hydrocarbon Fuels," Fire Safety Journal, vol. 27, pp. 185-200, 1996.

Schmid, Helmut, et al., "Gas Generator Development for Fire Protection Purpose," Propellants, Explosives, Pyrotechnics, vol. 24, pp. 144-148, 1999.

TNO Defence, Security and Safety, "Solid Propellant Cool Gas Generators," 2 pages, prior to 2007.

U.S. Appl. No. 60/414,157, filed Sep. 28, 2002, to Joseph Michael Bennett, entitled, "In-Room Gas Generator Fire Protection System.".

"Water Mist-Fire-Suppression Experiment," NASA Glenn Research Center, Dec. 2001, 3 pages.

Yang, Jiann C., et al., "Solid Propellant Gas Generators: An Overview and Their Application to Fire Suppression," International Conference on Fire Research and Engineering, Sep. 10-15, 1995, Orlando, FL, 3 pages.

Pyrogen, "The new revolution in fire suppression technology," International Aircraft Systems, Fire Protection Working Group, Atlantic City, NJ. Aug. 29, 2000, 43 pages.

Communication pursuant to Article 94(3) EPC for European Patent Application No. 04812700.5, dated Apr. 21 2015, 4 pages.

Concurrently filed co-pending patent Application, David W. Parksinson et al., titled "Gas Generator,".

Co-pending U.S. Appl. No. 12/723,275, Additives for Liquid Cooled Inflators" Filed Mar. 12, 2010.

Co-Pending U.S. Appl. No. 12/723,331, "Multi-Stage Inflator," Filed Mar. 12, 2010.

Environmental Protection Agency (EPA) Significant New Alternatives Policy (SNAP). Federal Register, Rules and Regulations vol. 74, No. 1, (Jan. 2, 2009), pp. 21-29.

European Search Report for European Application No. EP1 0163294, dated Mar. 11, 2014, 2 pages.

Holland, G. et al., Sustainable Fire Protection for Military Vehicle and aircraft Applications" Suppression and Detection Research and Applications A Technical Working Conference, Orlando, Florida, Mar. 11-13, 2008 (12 Pages).

(56) References Cited

OTHER PUBLICATIONS

Kim, A. "Advances in Fire Suppression Systems," National Research Council Canada, Construction Technology Update No. 75, (Mar. 2011), pp. 1-6.
Kim, A. "Overview of Recent Progress in Fire Suppression Technology"National Research Council Canada-45690, 2nd NRIFD Symposium, Proceedings, Tokyo, Japan, (Jul. 2002), pp. 1-13 (15 pages).
Office Action and Search Report for Chinese Patent Application No. 201180073596.2, dated Jul. 10, 2015, 24 pages.
Notification of the First Office Action, State Intellectual Property Office of the People's Republic of China, Application No. CN 201180048185.8, Sep. 3, 2014, eight (8) pages (from 12296).
Reason for Rejection (Office Action) from the Japanese Patent Office, Japanese Patent Application No. 2012-532847, dated Aug. 12, 2014, three (3) pages (from 12296).
Reason for Rejection (Office Action) from the Japanese Patent Office, Japanese Patent Application No. 2012-532847, dated Jun. 17, 2015, seven (7) pages (from 12296).
Owens, J. "Physical and Environmental Properties of a Next Generation Extinguishing Agent," HOTWC 12th Proceedings (May 2002), 11 pages.
hittp://www.navair.navy.mil/techTrans/index.cfm?map=local.ccms.view.aB&doc=paper.4, pyrotechnic Fire Extinguishers Navair-T2 Technology Transfer, printed May 18, 2009.
Sampson, W. "Development of a 100% Solid Propellant Based Gas Generator Fire Suppression System," Halon options Technical Working Conference (HOTWC) 16th Proceedings (May 2006), pp. 1-11.
Sampson, et al. "Extinguishing Mechanism for Solid Propellant Based Gas Generator Fire Suppression System," 2011 Suppression, Detection and Signaling Research and Applications—A Technical Working Conference (Mar. 2011), pp. 1-14.
International Preliminary Examination Report for International Application No. PCT/CA03/01525 dated Jan. 17, 2005, 10 pages. (formerly cited as International Preliminary Examination Report, dated Jan. 17, 2005).
Bennett, Joseph Michael, U.S. Appl. No. 60/414,157, filed Sep. 28, 2002, entitled "In-Room Gas Generator Fire Protection System.".

* cited by examiner

MAN-RATED FIRE SUPPRESSION SYSTEM AND RELATED METHODS

CROSS-REFERENCE TO RELATED APPLICATIONS

This application is a continuation of U.S. patent application Ser. No. 11/409,257, filed Apr. 21, 2006, now U.S. Pat. No. 8,408,322, issued Apr. 2, 2013, which is a continuation-in-part of U.S. patent application Ser. No. 10/727,088, entitled MAN-RATED FIRE SUPPRESSION SYSTEM, filed Dec. 2, 2003, now abandoned, which is related to U.S. patent application Ser. No. 10/727,093, entitled METHOD AND APPARATUS FOR SUPPRESSION OF FIRES, also filed Dec. 2, 2003, now U.S. Pat. No. 7,337,856, issued Mar. 4, 2008, the disclosure of each of which is incorporated herein by this reference in its entirety. This application is related to U.S. patent application Ser. No. 13/149,541, filed May 31, 2011, pending, which is a continuation of U.S. patent application Ser. No. 11/409,257, filed Apr. 21, 2006, now U.S. Pat. No. 8,408,322, issued Apr. 22, 2013. The disclosure of U.S. patent application Ser. No. 13/149,541 is also incorporated herein by this reference in its entirety.

This application is also related to U.S. patent application Ser. No. 12/042,200, entitled METHOD AND APPARATUS FOR SUPPRESSION OF FIRES, filed Mar. 4, 2008, now U.S. Pat. No. 7,845,423, issued Dec. 7, 2010, which is a continuation of U.S. patent application Ser. No. 10/727,093, entitled METHOD AND APPARATUS FOR SUPPRESSION OF FIRES, filed Dec. 2, 2003, now U.S. Pat. No. 7,337,856, issued Mar. 4, 2008, and U.S. patent application Ser. No. 12/478,019 entitled GAS-GENERATING DEVICES WITH GRAIN-RETENTION STRUCTURES AND RELATED METHODS AND SYSTEMS, filed Jun. 4, 2009, now U.S. Pat. No. 8,672,348, issued Mar. 18, 2014.

FIELD

The present invention relates to a fire suppression system. More specifically, the present invention relates to a fire suppression system suitable for use in human-occupied or clean environments.

BACKGROUND

A fire involves a chemical reaction between oxygen and a fuel that is raised to its ignition temperature by heat. The fire is extinguished by removing oxygen, reducing a temperature of the fire, separating the oxygen and the fuel, or interrupting chemical reactions of the combustion. Halogen-containing agents, such as Halon agents, are chemical agents that have been effectively used to suppress or extinguish fires. These halogen-containing agents generate chemically reactive halogen radicals that interfere with combustion processes in the fire. However, many Halon agents, such as Halon 1211, Halon 1301, and Halon 2402, have been suggested to contribute to the destruction of stratospheric ozone in the atmosphere, which has led many countries to ban their use. Therefore, effective fire fighting replacements for Halon agents are being developed. For instance, fire suppression systems have been recently developed to extinguish fires in enclosed spaces that introduce a flow of inert gas into the enclosed space to extinguish the fire. Some fire suppression systems use a source of compressed gas as the inert gas. However, the compressed gas requires a large storage area, which adds additional bulk and hardware to the fire suppression system.

Other fire suppression systems have utilized a propellant to generate the inert gas. The propellant is ignited to generate the inert gas, which is then used to extinguish the fire. The inert gas typically includes nitrogen, carbon dioxide ($CO_2$), or water. Some propellants used in fire suppression systems produce up to 20% by volume of $CO_2$. While $CO_2$ is a nonflammable gas that effectively extinguishes fires, propellants that generate copious amounts of $CO_2$ cannot be used to extinguish fires in a human-occupied space because $CO_2$ is physiologically harmful. $CO_2$ has an Immediately Harmful to Life or Health (IDLH) value of a concentration of 4% by volume and causes the human breathing rate to quadruple at levels from 4% by volume to 5% by volume, loss of consciousness within minutes at levels from 5% by volume to 10% by volume, and death by asphyxiation with prolonged exposure at these or higher levels. In addition, it is difficult to produce $CO_2$ by combustion without producing significant amounts of carbon monoxide (CO), which has an IDLH of 0.12% by volume (i.e., 1200 parts per million (ppm)). Many propellants also produce other gaseous combustion products, such as ammonia ($NH_3$), which has an IDLH of 300 ppm; nitric oxide (NO), which has an IDLH of 100 ppm; or nitrogen dioxide ($NO_2$), which has an IDLH of 20 ppm. NO and $NO_2$ are collectively referred to herein as nitrogen oxides ("$NO_x$"). $CO_2$, CO, $NH_3$, and $NO_x$ are toxic to people and, therefore, producing these gases is undesirable, especially if the fire suppression system is to be used in a human-occupied space. Furthermore, many of these propellants produce particulate matter when they are combusted. The particulate matter may damage sensitive equipment, is potentially an inhalation hazard, irritates the skin and eyes, and forms a hazardous solid waste that must be properly disposed of. In U.S. Pat. No. 6,024,889 to Holland et al., a chemically active fire suppression composition is disclosed that includes an oxidizer, a fuel, and a chemical fire suppressant and produces $CO_2$, nitrogen, and water when combusted. The composition also undesirably produces smoke and particulate matter upon combustion.

Propellants based on sodium azide ($NaN_3$) have also been developed for use in fire suppression systems. While $NaN_3$-based propellants produce nitrogen as a combustion product, the propellants are problematic to produce on a large scale because $NaN_3$ is toxic. In addition, combusting the $NaN_3$ propellant produces corrosive and toxic combustion products, in the form of smoke, that are very difficult to collect or neutralize before the nitrogen is used to extinguish the fire.

A nonazide-based fire suppression system is disclosed in U.S. Pat. No. 5,957,210 to Cohrt et al. In the fire suppression system, ammonia is reacted with atmospheric air or compressed air to produce nitrogen and water vapor. The ammonia and air are reacted in a combustion chamber of a gas turbine to produce combustion gases that are exhausted into a mixing chamber before being introduced into an enclosed space. Water is sprayed into the combustion chamber to cool the combustion gases. The introduction of the combustion gases into the enclosed space reduces its oxygen content and extinguishes the fire.

Other fire suppression systems utilize a combination of compressed gases and propellants. In U.S. Pat. No. 6,016,874 to Bennett, a fire extinguishing system is disclosed that uses compressed inert gas tanks and solid propellant gas generants that produce inert gases. The solid propellant gas generants are either azide- or nonazide-based and produce nitrogen or $CO_2$ as combustion products while argon or $CO_2$ are used as the compressed gases. The inert gases from each of these sources are combined to produce an inert gas having 52% nitrogen, 40% argon, and 8% $CO_2$ that is used to extinguish the fire.

In U.S. Pat. No. 5,449,041 to Galbraith, an apparatus for extinguishing fires is disclosed. The apparatus includes a gas generant and a vaporizable liquid. When ignited, the gas generant produces $CO_2$, nitrogen, or water vapor at an elevated temperature. The hot gases interact with the vaporizable liquid to convert the liquid to a gas, which is used to extinguish the fire.

BRIEF SUMMARY

The present invention relates to a fire suppression system that comprises a gas generant and a heat management system. The gas generant may be formed into a pellet that is housed in a combustion chamber of the fire suppression system. Upon combustion, the gas generant pyrotechnically produces an inert gas mixture that may be used to extinguish a fire. The gas generant may produce at least one gaseous combustion product and at least one solid combustion product when combusted. The gas generant may be formulated to produce minimal amounts of toxic gases, particulates, or smoke when combusted. The inert gas mixture may comprise nitrogen and water and be dispersed from the fire suppression system within from approximately 20 seconds to approximately 60 seconds after ignition of the gas generant. The fire suppression system may also include an igniter composition that is present in powdered, granulated, or pelletized form. The igniter composition may be formed into a pellet with the gas generant.

The fire suppression system also comprises an ignition train, a combustion chamber, and an effluent train that includes the heat management system. The heat management system cools the temperature of the inert gas mixture before the inert gas mixture exits the fire suppression system. The inert gas mixture may be cooled by flowing the inert gas mixture over a heat sink or a phase change material.

When ignited, the igniter composition may produce gaseous combustion products and solid combustion products that provide sufficient heat to ignite the gas generant. The igniter composition may be a composition including from approximately 15% to approximately 30% boron and from approximately 70% to approximately 85% potassium nitrate (known in the art as "$B/KNO_3$"), a composition including strontium nitrate, magnesium, and a binder ("$Mg/Sr(NO_3)_2$/binder"), or mixtures thereof. The gas generant may be a composition that includes hexa(ammine)cobalt(III)-nitrate ("HACN"), cupric oxide (CuO), titanium dioxide ($TiO_2$) and polyacrylamide ($[CH_2CH(CONH_2]_n$) or a composition that includes HACN, cuprous oxide ($Cu_2O$), and $TiO_2$. At least one of an inorganic binder, an organic binder, or a high-surface area conductive material may also be used in the gas generant.

The present invention also relates to a method of extinguishing a fire in a space. The method comprises igniting a gas generant to produce an inert gas mixture comprising a minimal amount of carbon monoxide, carbon dioxide, ammonia, or nitrogen oxides. The inert gas mixture is then introduced into the space to extinguish the fire. The gas generant may include a nonazide gas generant composition that produces gaseous combustion products and solid combustion products. Substantially all of the gaseous combustion products produced by the gas generant may form the inert gas mixture, which includes nitrogen and water. The gaseous combustion products may be produced within from approximately 20 seconds to approximately 60 seconds after ignition of the gas generant. The solid combustion products may form a solid mass, reducing particulates and smoke formed by combustion of the gas generant. The fire may be extinguished by reducing an oxygen content in the space to approximately 13% by volume.

The gas generant may be a composition that includes HACN, CuO, $TiO_2$, and polyacrylamide or a composition that includes HACN, $Cu_2O$, and $TiO_2$. At least one of an inorganic binder, an organic binder, or a high-surface area conductive material may also be used in the gas generant. An igniter composition may be used to combust the gas generant, such as a $B/KNO_3$ composition, a composition of $Mg/Sr(NO_3)_2$/binder, or mixtures thereof.

In accordance with one aspect of the present invention, a fire suppression system is provided that includes at least two gas generators wherein each gas generator includes a solid gas generant composition and is configured to generate a flow of gas into a defined space upon ignition of their respective solid gas generant compositions. The at least two gas generators are configured to ignite their respective gas generant compositions in a predetermined, time-ordered sequence. For example, the gas generator may ignite its gas generant composition at a first time while remaining gas generators may sequentially ignite their gas generant compositions at specified time intervals of, for example, one or more seconds.

In accordance with another aspect of the present invention, a method of suppressing a fire in a defined space is provided. The method includes providing a plurality of gas generators, each having a solid gas generant composition and arranging the plurality of gas generators within the defined space. The gas generant composition of each gas generator is ignited in a predetermined time-based sequence that provides predicted control of one or more flow characteristics of the generated gas within the defined space.

BRIEF DESCRIPTION OF THE SEVERAL VIEWS OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

DETAILED DESCRIPTION

Figure 1:
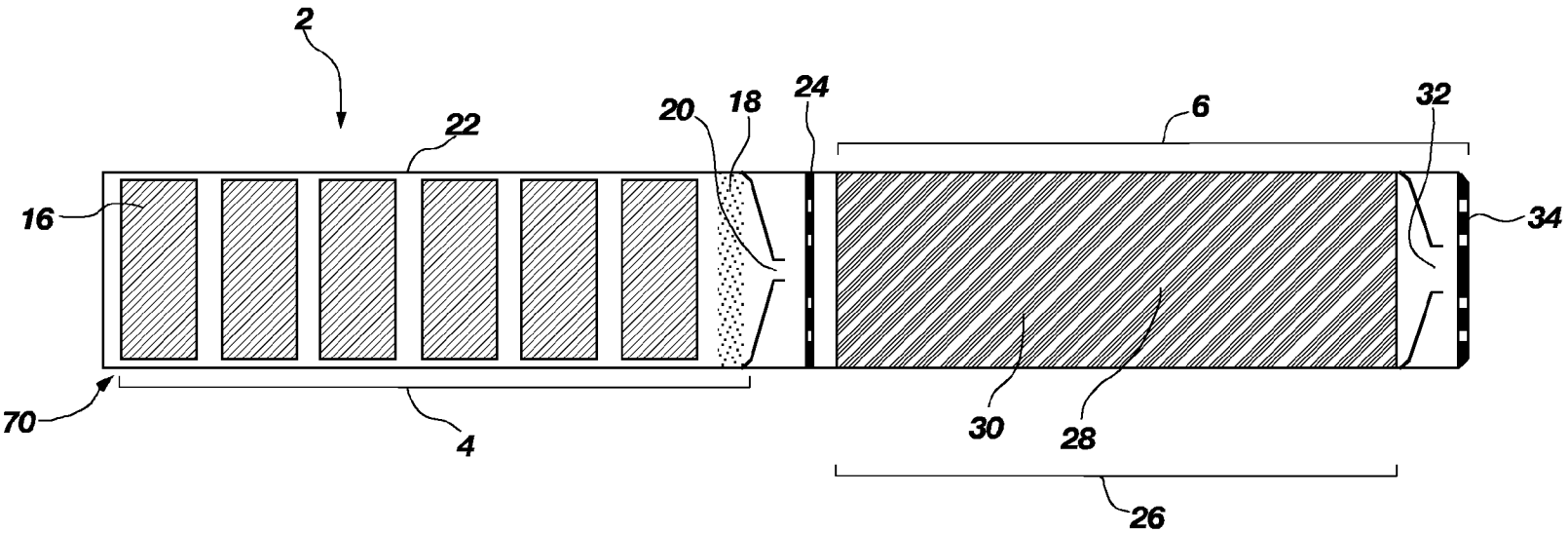
FIGS. 1 and 2 are schematic illustrations of an embodiment of a fire suppression system of the present invention.

A fire suppression system including a gas-generating device is disclosed. The gas-generating device produces an inert gas mixture that is introduced into a space having a fire. As used herein, the term "space" refers to a confined space or protected enclosure. The space may be a room or a vehicle that is occupied by humans, animals, or other living beings, or by electronic equipment. For instance, the space may be a room in a residential building, a commercial building, a military installation, or other building. The space may also be a vehicle or other mode of transportation, such as an automobile, an aircraft, a space shuttle, a ship, a motor boat, a train or subway, or a race car. Since the fire suppression system may be used in a space occupied by people, the fire suppression system is "man-rated." The fire suppression system may also be used in a clean environment, such as a room or vehicle that is used to store or house electronic equipment.

The inert gas mixture may be generated pyrotechnically by igniting a gas generant that produces gaseous combustion products. The gaseous combustion products may include gases that do not contribute to ozone depletion or global warming. As such, these gases may be used in the inert gas mixture. The gaseous combustion products may include minimal, nonhazardous amounts of noxious gases, such as $NH_3$, CO, $NO_x$, or mixtures thereof. In one embodiment, the gas generant produces significantly less than the respective IDLH of each of these gases and less than 1% of an original weight of the gas generant in particulates or smoke. The gas generant may also produce minimal amounts of other carbon-containing gases, such as $CO_2$. In one embodiment, the gas generant produces less than approximately 4% by volume of $CO_2$. The gas generant may be formulated to produce minimal carbon dioxide, particulates, or smoke when combusted and to produce a physiologically acceptable balance of toxic gases produced under fuel-rich (CO and $NH_3$) or fuel-lean ($NO_x$) conditions. Solid combustion products are ultimately produced upon combustion of the gas generant and may be essentially free of products that vaporize at the flame temperature of the gas generant and may solidify upon cooling to produce particulates and smoke that are respirable.

The inert gas mixture is generated in a short time frame, so that the fire may be extinguished quickly. For instance, the gas generant may be ignited, produce the inert gas mixture, and the inert gas mixture dispersed into the space within a time frame ranging from approximately 20 seconds to approximately 60 seconds. The inert gas mixture may decrease the oxygen content in the space so that oxygen-promoted combustion reactions in the fire may be suppressed or extinguished. The inert gas mixture may also decrease the oxygen content by creating an overpressure in the space, which causes oxygen-containing gases that were present in the space to exit by a positive pressure venting system and be replaced by the inert gas mixture. The positive pressure venting system for a given space may be designed to prevent a significant overpressure in the room.

Figure 2:
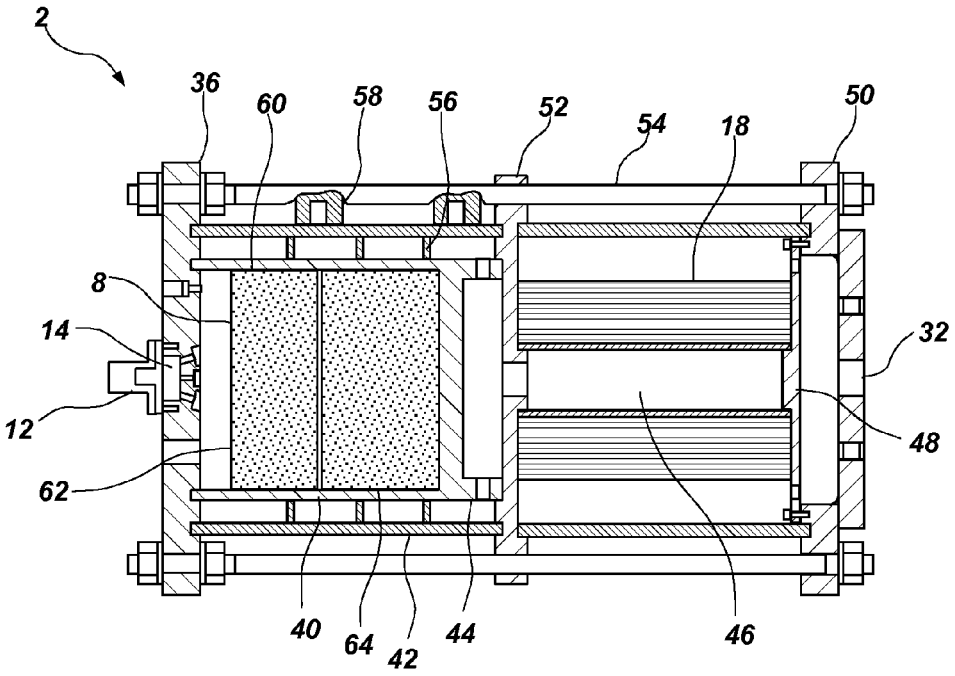

Referring generally to FIGS. 1 and 2, a fire suppression system 2 may include a gas generator 70 having a gas generant 8 disposed in a combustion chamber 4 and an effluent train 6. The fire suppression system 2 may be formed from a material and construction design having sufficient strength to withstand pressures generated by the gas generant 8. The pressures generated in the fire suppression system 2 may range from approximately 100 pounds per square inch ("psi") to approximately 1,000 psi. In one embodiment, such pressures range, more specifically, from approximately 600 psi to approximately 800 psi. In another embodiment, such pressures range from approximately 400 psi to approximately 800 psi. As will be appreciated by those of skill in the art, such pressures may differ depending, for example, on the type of gas generant 8 being used, the volume of gas to be produced thereby, the volume of the space being protected and other similar factors.

Figure 3A:
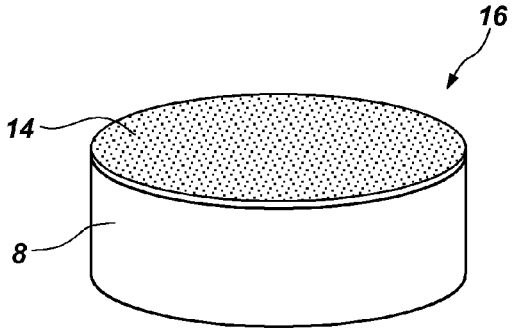
FIGS. 3*a* and 3*b* are schematic illustrations of a gas generant pellet, optionally including an igniter, usable in the fire suppression system of the present invention.
Figure 3B:
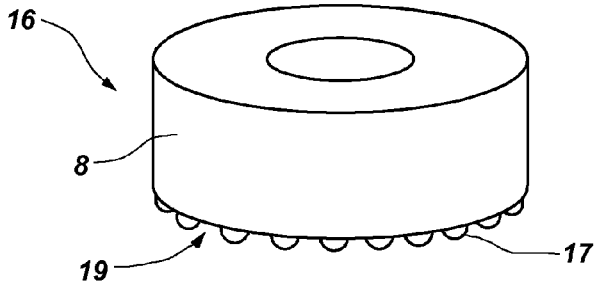

To withstand these pressures, an outer surface of the combustion chamber 4 and the effluent train 6 may be formed, for example, from a metal, such as steel or another suitable metal or metal alloy. The ignition train (including an initiating device 12) may be electrically activated, as known in the art. The gas generant 8 and an igniter composition 14 may be housed in the combustion chamber 4. The gas generant 8 may be present in the combustion chamber 4 as a pellet 16 or the gas generant 8 and the igniter composition 14 may be pelletized, as described in more detail below. Embodiments of the pellet 16 are illustrated in FIGS. 3*a* and 3*b* and are described in more detail below.

The gas generant 8 in the combustion chamber 4 may be ignited to produce the gaseous combustion products of the inert gas mixture by an ignition train using sensors that are configured to detect the presence of the fire in the space. The sensors may initiate an electrical impulse in the ignition train. Such sensors are conventional and, as such, are not discussed in detail herein. The electrical impulse may then ignite an initiating device 12, such as a squib, semiconductor bridge, or other conventional initiating device. Heat flux from the initiating device 12 may be used to ignite the igniter composition 14, which, in turn, ignites the gas generant 8. The igniter composition 14 and the gas generant 8 are described in more detail below. When ignited or combusted, the igniter composition 14 may produce an amount of heat sufficient to ignite the gas generant 8. Alternatively, the initiating device 12 may be used to directly ignite the gas generant 8. In one embodiment, the igniter composition 14 produces solid combustion products, with minimal production of gaseous combustion products. The combustion products produced by this igniter composition 14 may include a minimal amount of carbon-containing combustion products.

In addition to housing the ignition train, the combustion chamber 4 may house the igniter composition 14 and the gas generant 8. The gas generant 8 may be formed into a pellet 16 for use in the fire suppression system 2. Alternatively, the pellet 16 may include the gas generant 8 and the igniter composition 14, with the igniter composition 14 present predominantly on an outer surface of the pellet 16. The gas generant 8 may be a nonazide gas generant composition that produces gaseous combustion products and solid combustion products. The gaseous combustion products may be substantially free of carbon-containing gases or $NO_x$. Effluents produced by the combustion of the gas generant 8 may be substantially free of $NO_2$ and may have less than 100 parts per million ("ppm") of other effluents, such as CO or $NH_3$. For instance, the gas generant 8 may produce nitrogen and water as its gaseous combustion products. At least a portion of the gaseous combustion products produced by combustion of the gas generant 8 may form the inert gas mixture. In one embodiment, substantially all of the gaseous combustion products form the inert gas mixture so that a mass of the gas generant 8 used in the pellet 16 may remain as small as possible but yet still produce an effective amount of the inert gas mixture to extinguish the fire. A catalyst may also be present in the gas generant 8 to convert undesirable, toxic gases into less toxic, inert gases that may be used in fire suppression. The gaseous combustion products may be generated within a short amount of time after the gas generant 8 is ignited. For instance, the gas generant 8 may produce the gaseous combustion products within approximately 20 seconds to approximately 60 seconds after its ignition so that the inert gas mixture may be dispersed and the fire extinguished within approximately 30 seconds to approximately 60 seconds.

During combustion of the gas generant 8, substantially all of the combustion products that are solid at ambient temperature congeal into a solid mass, reducing particulates and smoke formed by combustion of the gas generant. The solid combustion products may produce a slag, which includes metallic elements, metal oxides, or combinations thereof. The slag may fuse on or near a burning surface of the pellet 16 when the gas generant 8 is combusted, producing a porous, monolithic frit. Since the slag fuses into a porous mass at or near the surface of the pellet 16 as it combusts, particulates produced during combustion of the pellet 16 may be minimized.

In one embodiment, the gas generant 8 is an HACN composition, as disclosed in U.S. Pat. Nos. 5,439,537 and 6,039,820, both to Hinshaw et al., the disclosure of each of which patents is incorporated by reference herein. The HACN used in the gas generant 8 may be recrystallized and include less than approximately 0.1% activated charcoal or carbon. By maintaining a low amount of carbon in the gas generant 8, the amount of carbon-containing gases, such as CO, $CO_2$, or mixtures thereof, may be minimized upon combustion of the gas generant 8. In another embodiment, the HACN may be unrecrystallized and include less than approximately 0.1% activated charcoal. Such an HACN composition is commercially available from Autoliv Inc. of Ogden, Utah. In yet another embodiment, a technical grade HACN having up to approximately 1% activated charcoal or carbon may be used. It is also contemplated that conventional gas generants 8 that produce gaseous combustion products that do not include carbon-containing gases or $NO_x$ may also be used.

The HACN composition, or other gas generants 8, may include additional ingredients, such as at least one of an oxidizing agent, ignition enhancer, ballistic modifier, slag-enhancing agent, cooling agent, chemical fire suppressant, inorganic binder, or an organic binder. Many additives used in the gas generant 8 may have multiple purposes. For sake of example only, an additive used as an oxidizer may provide cooling, ballistic modifying, or slag-enhancing properties to the gas generant 8. The oxidizing agent may be used to promote oxidation of the activated charcoal present in the HACN or of the ammonia groups coordinated to the cobalt in the HACN. The oxidizing agent may be an ammonium nitrate, an alkali metal nitrate, an alkaline earth nitrate, an ammonium perchlorate, an alkali metal perchlorate, an alkaline earth perchlorate, an ammonium peroxide, an alkali metal peroxide, or an alkaline earth peroxide. The oxidizing agent may also be a transition metal-based oxidizer, such as a copper-based oxidizer, that includes, but is not limited to, basic copper nitrate ($[Cu_2(OH)_3NO_3]$) ("BCN"), $Cu_2O$, or CuO. In addition to being oxidizers, the copper-based oxidizer may act as a coolant, a ballistic modifier, or a slag-enhancing agent. Upon combustion of the gas generant 8, the copper-based oxidizer may produce copper-containing combustion products, such as copper metal and cuprous oxide, which are miscible with cobalt combustion products, such as cobalt metal and cobaltous oxide. These combustion products produce a molten slag, which fuses at or near the burning surface of the pellet 16 and prevents particulates from being formed. The copper-based oxidizer may also lower the pressure exponent of the gas generant 8, decreasing the pressure dependence of the burn rate. Typically, HACN-containing gas generants 8 that include copper-based oxidizers ignite more readily and burn more rapidly at or near atmospheric pressure. However, due to the lower pressure dependence, they burn less rapidly at extremely high pressures, such as those greater than approximately 3000 psi.

The ignition enhancer may be used to promote ignition of the gas generant 8 at a low positive pressure, such as from approximately 14 psi to approximately 500 psi. The ignition enhancer may be a conductive material having a large surface area. The ignition enhancer may include, but is not limited to, amorphous technical grade boron, high surface area flaked copper, or flaked bronze. The ballistic modifier may be used to decrease the burn rate pressure exponent of the gas generant. For instance, if the gas generant 8 includes cupric oxide and submicron particle size titanium dioxide, the gas generant may have a pressure exponent of less than approximately 0.3. Another ballistic modifier that may be used in the gas generant 8 is high surface area iron oxide. The ballistic modifier may also promote ignition of the gas generant 8. Additives that are able to provide ballistic modifying and ignition-enhancing properties may include, but are not limited to, high surface area transition metal oxides and related species, such as basic copper nitrate and flaked metals, such as flaked copper.

The cooling agent may be used to lower the flame temperature of the gaseous combustion products. Since high flame temperatures contribute to the formation of toxic gases, such as NO and CO, cooling the gaseous combustion products is desirable. In addition, by using the cooling agent in the gas generant 8, less cooling of the gaseous combustion products may be necessary in the effluent train 6. The cooling agent may absorb heat due to its intrinsic heat capacity and, potentially, from an endothermic phase change, such as from a solid to a liquid, or an endothermic reaction, such as a decomposition of metal carbonates or metal hydroxides to metal oxides and carbon dioxide or water, respectively. Many of the additives previously described, such as the oxidizing agent, the ignition enhancer, and the ballistic modifier, may act as the cooling agent. For instance, the cooling agent may be a metal oxide, non-metal oxide, metal hydroxide, metal carbonate, or a hydrate thereof. However, desirably, the cooling agent is not a strong oxidizing or reducing agent.

The slag-enhancing agent may be used to meld the combustion products of the gas generant 8 into a cohesive solid, but porous, mass. Upon combustion of the gas generant 8, the slag-enhancing agent may melt or produce molten combustion products that adhere to the solid combustion products and join the solid combustion products into the solid mass. Since the solid combustion products are melded together, the amount of smoke or particulates produced may be reduced. Silicon dioxide ($SiO_2$), titanium oxide, magnesium oxide, or copper-containing compounds may be used as the slag-enhancing agent. Desirably, titanium oxide or magnesium oxide is used because they produce low levels of $NO_x$ upon combustion of the gas generant 8. The concentration of $NO_x$ in the gaseous combustion products may also be reduced by including a catalyst for $NO_x$ in the gas generant 8. For sake of example only, the catalyst may be tungsten oxide, which converts $NO_x$ to nitrogen in the presence of ammonia.

The chemical fire suppressant or chemical fire retardant may also be used in the gas generant 8. The chemical fire suppressant may be a compound or a mixture of compounds that affects flames of the fire, such as a compound that delays ignition and reduces the spread of the flames in the space. The chemical fire suppressant may trap radicals, such as H, OH, O, or $HO_2$ radicals, which are important to oxidation in the vapor phase. The chemical fire suppressant may be a halogenated organic compound, a halogenated inorganic compound, or mixtures thereof.

The inorganic binder may provide enhanced pellet integrity when the pellet 16 is subjected to mechanical or thermal shock. The inorganic binder may be soluble in a solvent that is used to process the gas generant 8, such as water. As the solvent evaporates, the inorganic binder may coat solid particles of the gas generant 8, which enhances crush strength of granules and pellets 16 produced with the gas generant 8. In addition, since the binder is inorganic, carbon-containing gases such as CO or $CO_2$, may not be produced when the gas generant is combusted. The inorganic binder may include, but is not limited to, a silicate, a borate, boric acid, or a mixture thereof. For instance, sodium silicate, sodium metasilicate ($Na_2SiO_3.5H_2O$), sodium borosilicate, magnesium silicate, calcium silicate, aluminosilicate, aluminoborosilicate, or sodium borate may be used as the inorganic binder. In addition, HACN may act as the inorganic binder.

Small amounts of an organic binder may also be used in the gas generant 8 as long as minimal amounts of CO or $CO_2$ are produced during combustion. Gas generants 8 that include even a small amount of organic binder may have improved crush strength in pellet form compared to gas generants 8 that are free of organic binders. The organic binder may be present in the gas generant 8 from approximately 0.5% to approximately 2.0%. The organic binder may be a synthetic or naturally occurring polymer that dissolves or swells in water including, but not limited to, guar gum, polyacrylamide, and copolymers of polyacrylamide and sodium polyacrylate. The organic binder, in powder form, may be blended with dry ingredient(s) prior to the addition of water to promote dispersion of the organic binder. A sufficient amount of water may be added during mixing to produce a thick paste, which is subsequently dried and granulated prior to pelletization. Organic binders that dissolve or swell in organic solvents may also be used, such as ethyl cellulose, which dissolves or swells in ethanol. Gas generants 8 that include ethyl cellulose may be dry blended prior to mixing in the ethanol. The resulting thick paste may be subsequently dried and pressed into pellets 16. Curable polymeric resins may also be used as organic binders in the gas generant 8. The curable polymeric resin may be blended with the gas generant 8 and a curative in the absence of solvent or in the presence of a small amount of solvent to promote dispersion of the small amounts of the curable polymeric resin and the curative. The resulting powder may be pressed into a pellet 16 and allowed to cure at elevated temperature, such as at a temperature of approximately 135° F. The curable polymeric resin may include, but is not limited to, epoxy-cured polyesters and hydrosilylation-cured vinylsilicones. The organic binder may also include water-soluble, organic compounds that have a low carbon content, such as guanidine nitrate. If guanidine nitrate is used as the organic binder, it may be present in the gas generant 8 from approximately 1.0% to approximately 5.0%.

The gas generant 8 may further include organic or inorganic fibers. As with other ingredients discussed hereinabove, such fibers may be used to enhance the mechanical integrity, the ignition properties, the ballistic properties or any combination of such properties of the gas generant 8 or pellets 16 formed therefrom. If organic fibers are used, it may be desirable to use a material that does not combust so as to prevent, or at least minimize, the likelihood of any additional carbon oxides being present in the gas generated by the fire suppression system 2.

In one embodiment, the gas generant 8 used in the fire suppression system 2 includes recrystallized HACN, cupric oxide (CuO), titanium dioxide ($TiO_2$), and high molecular weight polyacrylamide ($[CH_2CH(CONH_2]_n$). In another embodiment, the gas generant 8 includes recrystallized HACN, CuO, silicon dioxide ($SiO_2$), $TiO_2$, and polyacrylamide. In another embodiment, the gas generant 8 includes recrystallized HACN, cuprous oxide ($Cu_2O$), and $TiO_2$. In yet another embodiment, that gas generant 8 includes as-formed, or unrecrystallized, HACN with less than 0.1% charcoal, CuO, $TiO_2$, polyacrylamide binder, and chopped glass fibers having a diameter of, for example, approximately 1/32 of an inch.

The gas generant 8 may be produced by a variety of methods, such as by using a vertical mixer, a muller mixer, a slurry reactor, by dry blending, by extruding, or by spray drying the ingredients of the composition. In the vertical mixer, the solid ingredients of the gas generant 8 may be mixed in a solution that includes HACN dissolved in from approximately 15% by weight to approximately 45% by weight water. Ignitability and ease of combusting the gas generant 8 may increase when high concentrations of HACN are dissolved during the mixing process. The water may be heated to 165° F. to increase the solubility of the HACN. Mixing the gas generant 8 at high water content (greater than approximately 35% by weight) and warm temperature (greater than approximately 145° F.) dissolves at least a portion of the HACN and coats the additional ingredients. A high shear mixer, such as a dispersator, may be used to completely wet the high surface area solid ingredients before adding them to the vertical mixer or the high surface area solid ingredients may be preblended in a dry state. A powdered binder may be blended with the HACN prior to addition of water or another appropriate solvent. The slurry may be dried in a convection oven.

In one embodiment, a muller mixer is used to disperse the curable polymeric resin and the curative into the powdered ingredients of the gas generant 8. A small amount of solvent may also be added to promote dispersal of the curable polymeric resin and the curative. The gas generant 8 including the curable polymeric resin is allowed to cure once it has been pressed into the pellet 16.

To form the gas generant 8 in the slurry reactor, the HACN may be completely dissolved in water at a temperature of approximately 180° F. If technical grade HACN is used, any activated charcoal in the heated HACN solution may be removed, such as by filtration or another process. The heated HACN solution may be added to a cool, rapidly mixed suspension of the solid ingredients of the gas generant 8. Alternatively, a predispersed slurry of the solid ingredients may be slowly added to the rapidly stirred, HACN solution as it cools. Either of these methods may promote the formation of HACN crystallites on the insoluble solid ingredients of the gas generant 8. Once the suspension is cooled to a temperature ranging from at least approximately 80° F. to approximately 100° F., it may be filtered and the solids dried. The filtrate may be recycled as the liquid phase in subsequent slurry mixes.

To dry blend the gas generant 8, the HACN may be mixed with the other ingredients of the gas generant 8 using a v-shell, rotary cone, or Forberg blender. A small amount of moisture may be added to the mixture to minimize dusting. The mixture may then be dried before pelletization.

In one example of an extrusion process, the HACN and other ingredients are mixed into a powder blend. The dry blend is then metered into an extruder along with a controlled flow of water. The generant 8 is mixed in the extruder and either exits as wet granules or is extruded through a die to form a desired shape as will be appreciated by those of ordinary skill in the art. The granules or the extruded shapes may then be dried prior to further processing or use thereof in the fire suppression system 2.

In an example of spray drying, the HACN and other ingredients are mixed with water to form a slurry. The slurry is pumped into an air heated spray drying chamber through an atomizing device. The atomized slurry is then flash dried by the heated air to form dry granules. The dried granules are removed from the air stream by a separating device such as, for example, a cyclone or a bag filter, and then collected. The granules may then be pressed into pellets 16.

As previously described, the gas generant 8 or the igniter composition 14 and the gas generant 8 may be formed into the pellet 16. The pellet 16 may be formed by compressing the gas generant 8 or the igniter composition 14 and the gas generant 8 together to form a cylindrically shaped pellet 16, as illustrated in FIG. 3*a*. However, the geometry of the gas generant 8 used in the fire suppression system 2 may depend on a desired ballistic performance of the gas generant 8, such as a desired burn rate or rate of evolution of the inert gas mixture as a function of time. Burn rates are typically categorized as a progressive burn, a regressive burn, or a neutral burn. A progressive burn is provided when the burning surface of the pellet 16 increases gradually as the pellet 16 burns. In a progressive burn, the rate of evolution of the inert gas mixture increases as a function of time. A regressive burn is provided when the burning surface of the pellet 16 decreases gradually as the pellet 16 burns. In a regressive burn, the rate of evolution of the inert gas mixture is initially high and decreases as a function of time. If the burning surface of the pellet 16 burns at a constant rate, a neutral burn is provided. In one embodiment, the gas generant 8 is formed into a pellet 16 having a center-perforated grain geometry, as illustrated in FIG. 3*b*. The center-perforated grain geometry has a high surface area, burns rapidly, and provides a neutral burn. The pellet 16 may also be formed into other shapes that provide a neutral burn as opposed to a regressive or progressive burn. The center-perforated pellet 16 may be produced using an appropriately designed die or by drilling a hole into a cylindrical pellet 16, using appropriate safety precautions.

In one embodiment, and as illustrated in FIG. 3*b*, the pellets 16 may be pressed or otherwise formed to exhibit one or more surface features 17, such as protrusions on one or more end surfaces 19. Such surface features 17 act as stand-offs when the pellets 16 are stacked end-to-end and provide an air gap between adjacent pellets 16 or between the end of a pellet 16 and another surface of the combustion chamber 4. The air gap defined between pellets 16 enables a combustion flame to more efficiently spread to all of the pellets in a combustion chamber 4. The pellets 16 may be stacked in a retaining structure, such as a wire mesh cage, to maintain the pellets in a desired stack arrangement. Such a cage helps to maintain the pellets in desired position within the gas generator 70 and helps to prevent damage to the pellets 16 during handling of the generators 70. In another embodiment, instead of forming surface features 17 on the pellets 16 (or in addition thereto) such a cage may be configured to maintain the pellets 16 at a desired distance from one another so as to define a specified air gap.

The pellet 16 may include at least one layer of the igniter composition 14 in contact with one or more surfaces of the gas generant 8. A configuration of the igniter composition 14 used in the fire suppression system 2 may depend on the geometry of the gas generant 8. For instance, the pellet 16 may include a layer of the igniter composition 14 above a layer of the gas generant 8. Alternatively, a layer of the igniter composition 14 may be present below the gas generant 8 or may be present on multiple surfaces of the pellet 16. The igniter composition 14 may also be pressed on the surface of the pellet 16. Alternatively, the igniter composition 14 may be powdered, granulated, or pelletized and housed in a metal foil packet or other pouch that is placed on or near the surface of the pellet 16. The metallic foil packet may include steel wool or another conductive material that absorbs heat from the igniter composition 14 and transfers it to the surface of the gas generant 8. The igniter composition 14 may also be placed in a perforated flash tube within the center-perforation of the pellet 16. If the igniter composition 14 is granular or powdered, the perforated flash tube may be lined internally or externally with a metal foil or the igniter composition 14 may be inserted into the perforated flash tube in preloaded foil packets.

In one embodiment, the igniter composition 14 includes from approximately 15% to approximately 30% boron and from approximately 70% to approximately 85% potassium nitrate. This igniter composition 14 is known in the art as "$B/KNO_3$" and may be formed by conventional techniques. In another embodiment, an igniter composition 14 having strontium nitrate, magnesium, and small amounts of a polymeric organic binder, such as nylon, may be used. The igniter composition 14 is referred to herein as a $Mg/Sr(NO_3)_2$/binder composition. If the organic binder is nylon, the igniter composition 14 is referred to herein as a $Mg/Sr(NO_3)_2$/nylon composition. Since magnesium is water reactive, the organic binder used in the igniter composition 14 may be soluble in organic solvents. For instance, ethyl cellulose or polyvinylacetate may also be used as the organic binder. The $Mg/Sr(NO_3)_2$/binder composition may be formed by conventional techniques. The igniter composition 14 may also include mixtures of $B/KNO_3$ and $Mg/Sr(NO_3)_2$/binder. The igniter compositions disclosed in U.S. Pat. No. 6,086,693, the disclosure of which patent is incorporated by reference herein in its entirety, may also be used as the igniter composition 14.

The pellet 16 may be formed by layering the granules of the igniter composition 14 above or below the layer of the gas generant 8 in a die so that the igniter composition 14 and the gas generant 8 are in contact with one another. A pressure of approximately 8,000 psi may be used to form the pellet 16, which has a porosity ranging from approximately 5% to approximately 20%. The igniter composition 14 and the gas generant 8 may be compressed into the pellet 16 using a metal sleeve or a metal can, which provides support while the pellet 16 is being produced, handled, or stored. The metal can or the metal sleeve may also be used to inhibit burning of surfaces of the pellet 16 that are enclosed by the metal sheathing. In the fire suppression system 2 of the present invention, the pellet 16 may burn at a controlled rate so that the amount of inert gas mixture produced during the burn remains constant as a function of time. To achieve a neutral burn, at least one surface of the pellet 16 may be covered or inhibited by the metal can or metal sleeve so that these surfaces do not burn. An inner surface of the metal sheathing may also be painted with an inert inorganic material, such as sodium silicate or a suspension of magnesium oxide in sodium silicate, to inhibit the surfaces of the pellet 16.

The pellets 16 may be housed in the combustion chamber 4 and have a total mass that is sufficient to produce an amount of the inert gas mixture sufficient for extinguishing the fire in the space. For sake of example only, in order to lower the oxygen concentration and extinguish a fire in a 1,000 cubic foot space, the gas generant 8 may have a total mass of approximately 40 pounds. The inert gas mixture produced by the combustion of the gas generant 8 may lower the oxygen concentration in the space to a level that sustains human life for a limited duration of time. For instance, the oxygen concentration in the space may be lowered to approximately 13% by volume for approximately five minutes.

The combustion chamber 4 may be configured to house multiple pellets 16 of the gas generant 8 or the igniter composition 14 and the gas generant 8. Therefore, the fire suppression system 2 of the present invention may be easily configured for use in spaces of various sizes. For instance, the fire suppression system 2 may include one pellet 16 if the fire suppression system 2 is to be used in a small space. However, if the fire suppression system 2 is to be used in a larger space, the combustion chamber 4 may include two or more pellets 16 so that the sufficient amount of the inert gas mixture may be produced. For sake of example only, in a 500 cubic foot space, four pellets 16 having a 5.8 inch outer diameter, a 2.6 inch height, and a weight of 4.44 pounds may be used, while eight of these pellets 16 may be used in a 1,000 cubic foot space. In a 2,000 cubic foot space, two gas generators 70, each containing eight pellets 16, may be strategically positioned. The pellets 16 may have an effective burning surface area so that the inert gas mixture may be produced within a short time period after initiation of the gas generant 8. For instance, the inert gas mixture may be produced with approximately 20 seconds to approximately 60 seconds after initiation of the gas generant 8. If the fire suppression system 2 includes multiple pellets 16, the pellets 16 may be ignited so that they are combusted simultaneously to provide a sufficient amount of the inert gas mixture to extinguish the fire. Alternatively, the pellets 16 may be ignited sequentially so that the inert gas mixture is produced at staggered intervals.

In one embodiment, the ignition train includes a squib, which, when electrically activated, ignites a granular or pelletized composition of $B/KNO_3$ in an ignition chamber. The hot effluents produced by combustion of the $B/KNO_3$ composition pass into the combustion chamber 4 and ignite the secondary ignition or igniter composition 14, which may be located in the metallic foil packet or other pouch, pressed or painted on the surface of the pellet 16, or placed in the perforated flash tube positioned in the center-perforation of the pellet 16.

Figure 4:
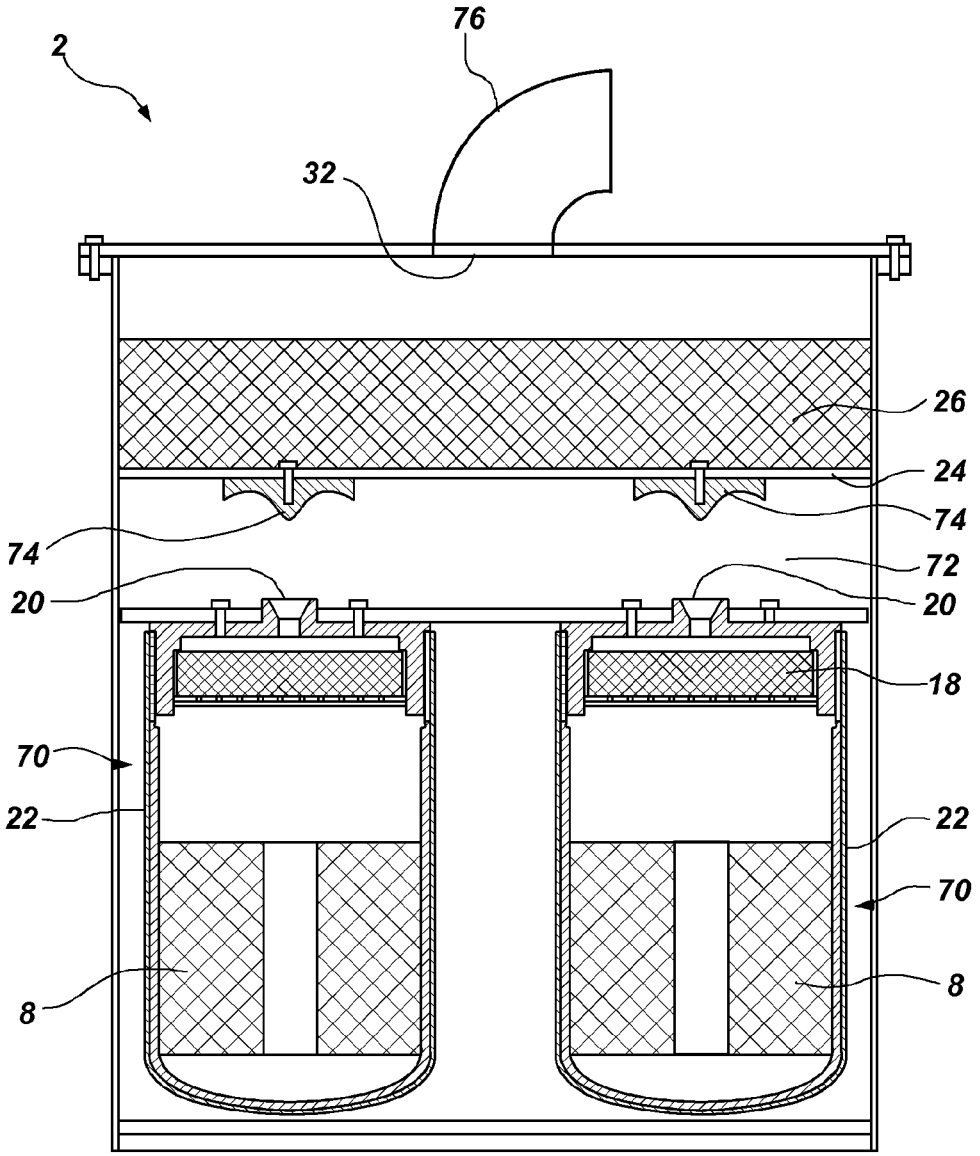
FIG. 4 is a schematic illustration of an embodiment of the fire suppression system of the present invention.

The fire suppression system 2 may be designed in various configurations depending on the size of the space in which the fire is to be extinguished. Example configurations of the fire suppression system 2 include, but are not limited to, those illustrated in FIGS. 1 and 4. In one embodiment, as illustrated in FIG. 4, the fire suppression system 2 may have a tower configuration having a plurality of gas generators 70. A group or cluster of the gas generators 70 may be utilized to generate a sufficient amount of the inert gas mixture, which is delivered to the space in which the fire is to be suppressed. The number of gas generators 70 in the cluster, and a controllable sequence in which the gas generators 70 are initiated, enables the ballistic performance of the fire suppression system 2 to be tailored to provide a sufficient amount of the inert gas mixture to the space. The number of gas generators 70 may also be adjusted to provide a desired mass flow rate history and action time of the inert gas mixture to the space. To configure the fire suppression system 2 for a particular space, gas generators 70 may be added to or removed from the tower cluster. The fire sequencing used to initiate the gas generators 70 may be accomplished by controlling the timing of the electrical impulse to the initiating device 12 or by utilizing a pyrotechnic fuse. A column length of the pyrotechnic fuse may be selected to determine the time of initiation of the gas generator 70. The gas generator 70 may house the gas generant 8, which is illustrated in FIG. 4 as having a center-perforated grain geometry. However, the gas generator 70 may accommodate other geometries of the gas generant 8 depending on the desired ballistic performance of the gas generant 8. The geometry of the igniter composition 14 used in the fire suppression system 2 may depend on the grain geometry of the gas generant 8. For instance, the igniter composition 14 may be loaded into the metallic foil packets or other pouches and placed on the surfaces of the gas generant 8. Alternatively, the igniter composition 14 may be placed in the perforated flash tube (not shown), which extends down the length of a center-perforated pellet 16 of the gas generant 8.

As previously described, the igniter composition 14 is ignited, which in turn combusts the gas generant 8 and produces the gaseous combustion products. The gaseous combustion products form the inert gas mixture, which then passes through a filter 18 and a controlling orifice 20 into a diffuser chamber 72. The filter 18 may be a screen mesh, a series of screen meshes, or a conventional filter device that removes particulates from the inert gas mixture. The filter 18 may also provide cooling of the inert gas mixture. The controlling orifice 20 controls the mass flow out of the gas generator 70 and, therefore, controls the flow rate of the inert gas mixture and the pressure within the gas generator 70. In other words, the controlling orifice 20 may be used to maintain a desired combustion pressure in the fire suppression system 2. The pressure in the gas generator 70 may be maintained at a level sufficient to promote ignition and to increase the burn rate of the gas generant 8. The pressure may also promote the reaction of reduced toxic gases, such as CO and $NH_3$, with gases that are oxidized, such as $NO_x$, which significantly reduces the concentration of these gases in the effluent gases. In one embodiment, the controlling orifice 20 may be of a sufficient size to produce a combustion pressure ranging, for example, from approximately 600 psi to approximately 800 psi in the combustion chamber 4 of the gas generator 70. In another embodiment, the controlling orifice 20 may be of a sufficient size to produce a combustion pressure ranging, for example, from approximately 400 psi to approximately 600 psi in the combustion chamber 4 of the gas generator 70. Therefore, the combustion chamber walls 22 of the gas generator 70, as well as other portions of the fire suppression system 2, may be formed from a material that is capable of withstanding the maximum working pressure at the operating temperatures with appropriate engineering safety factors. In the presently described tower configuration, high pressures of the fire suppression system 2 are restricted to the small diameter, combustion chamber 4 volumes, while the remainder of the fire suppression system 2 operates at low pressures, which results in cost and weight savings.

In the diffuser chamber 72, plumes of the high velocity, inert gas mixture impinge on a flow deflector 74. The flow deflector 74 recirculates the inert gas mixture and results in a more uniform flow through a perforated diffuser plate or first diffuser plate 24. The first diffuser plate 24 may disperse the inert gas mixture so that it does not exit the gas generator 70 as a high velocity jet. The inert gas mixture then passes through a heat management system 26 that includes cooling media or effluent scavenging media. The heat management system 26 may reduce the temperature of the inert gas mixture to a temperature that is appropriate to suppress the fire. Since combustion of the gas generant 8 produces a significant amount of heat in the gas generator 70, the inert gas mixture may be cooled before it is introduced into the space. For sake of example only, the heat released from a gas generant 8 combusted in a 2,000 cubic foot space may be approximately 40,000 British Thermal Units ("BTU"). In one embodiment, the heat management system 26 is a heat sink. The heat sink may be formed from conventional materials that are shaped into beds, beads, or tube clusters. The materials used in the heat sink may include, but are not limited to, metal, graphite, or ceramics. The material used in the heat sink and the geometry of the heat sink may be selected by one of ordinary skill in the art so that the heat sink provides the appropriate heat transfer surface, thermal conductivity, heat capacity, and thermal mass for the intended application.

In another embodiment, the heat management system 26 includes a phase change material ("PCM"). The PCM removes thermal energy from the inert gas mixture by utilizing the PCM's latent heat of fusion and stores the thermal energy. The PCM may be an inert material that does not react with the inert gas mixture including, but not limited to, a carbonate, phosphate, or nitrate salt. For instance, the PCM may be lithium nitrate, sodium nitrate, potassium nitrate, or mixtures thereof. The PCM is described in more detail below.

The cooled, inert gas mixture may then be dispersed into the space through at least one final orifice 32, which reduces the pressure of the inert gas mixture relative to the pressure in the gas generator 70. The geometry of the final orifice(s) 32 may be selected based on the geometry of the space and the placement of the fire suppression system 2 in the space. A flow diverter 76 may be positioned at the final orifice to direct the flow in a specific direction as it enters into the space being protected by the fire suppression system 2. It is noted that, since the inert gas mixture is generated pyrotechnically, high-pressure gas storage tanks and accompanying hardware to disperse the inert gas mixture may not be needed in the fire suppression system 2 of the present invention.

Another configuration of the fire suppression system 2 is shown in FIG. 1. The inert gas mixture, including nitrogen and water vapor, may be passed through the filter 18 to remove any particulates that are produced upon combustion of the gas generant 8. The inert gas mixture may then be flowed through the controlling orifice 20 located at the exit of the combustion chamber 4 of the gas generator 70. The controlling orifice 20 may control the mass flow out of the combustion chamber 4 and, therefore, may control the pressure within the combustion chamber 4. In other words, the controlling orifice 20 may be used to maintain a desired combustion pressure in the fire suppression system 2. The controlling orifice 20 may be of a sufficient size to produce a combustion pressure ranging from approximately 400 psi to approximately 600 psi in the combustion chamber 4. Therefore, walls 22 of the combustion chamber 4 and of the effluent train 6 may be formed from a material capable of withstanding the maximum working pressure at the operating temperatures with appropriate engineering safety factors.

The combustion chamber 4 may also include the first diffuser plate 24 that disperses or diffuses the inert gas mixture into the heat management system 26 of the effluent train 6. The first diffuser plate 24 may disperse the inert gas mixture so that it does not exit the combustion chamber 4 as a high velocity jet. Rather, a laminar flow of the inert gas mixture may enter the effluent train 6. The effluent train 6 may include the heat management system 26 or a gas coolant material to reduce the temperature of the inert gas mixture to a temperature appropriate to suppress the fire. In one embodiment, the heat management system 26 is a heat sink, as previously described. In another embodiment, the heat management system 26 includes a PCM 28. As previously described, the PCM 28 removes thermal energy from the inert gas mixture by utilizing the PCM's latent heat of fusion and stores the thermal energy. The PCM 28 may be an inert material that does not react with the inert gas mixture including, but not limited to, a carbonate, phosphate, or nitrate salt. For instance, the PCM 28 may be lithium nitrate, sodium nitrate, potassium nitrate, or mixtures thereof. The PCM 28 used in the heat management system 26 may be selected by one of ordinary skill in the art based on its phase change temperature, latent heat of fusion, or thermal properties, such as thermal conductivity, burn rate, heat capacity, density, or transition or melting temperature. In addition to these properties, the material selected as the PCM 28 may be dependent on the amount of time that is needed to ignite the gas generant 8 and produce the gaseous combustion products of the inert gas mixture. To transfer heat from the inert gas mixture to the PCM 28, a tube cluster 30 may be embedded in, or surrounded by, the PCM 28. The tube cluster 30 may be formed from metal tubes that are capable of conducting heat, such as steel or copper tubes. The length, inner diameter, and outer diameter of the metal tubes may be selected by one of ordinary skill in the art depending on the amount of time required for the heat produced by the gas generant 8 to be conducted from the inert gas mixture to the PCM 28. The geometry of the tube cluster 30 in relation to the PCM 28 may be selected by one of ordinary skill in the art based on the amount of time necessary to ignite the gas generant 8 and produce gaseous combustion products and the amount of heat produced by the gas generant 8. When the inert gas mixture is flowed from the combustion chamber 4 and through the tube cluster 30, heat flux from the inert gas mixture may be transferred through the tube cluster 30 and into the PCM 28. When the PCM 28 is heated to its phase change temperature, it may begin to absorb its latent heat of fusion. Once the PCM 28 has absorbed its latent heat of fusion, an interface boundary temperature differential of the PCM 28 remains constant, which may enhance heat conduction from the surface of the tube cluster 30 to the PCM. Thermal energy may be stored in the PCM 28 based on the heat capacity of its liquid state once the PCM 28 has absorbed its latent heat of fusion.

The heat management system 26 may also be doped with a selective catalytic reduction ("SCR") catalyst or a non-selective catalytic reduction ("NSCR") catalyst to convert any undesirable gases that are produced as gaseous combustion products into gases that may be used in the inert gas mixture. For instance, the SCR and NSCR catalysts may be used to convert ammonia or nitrogen oxides into nitrogen and water, which may then be used in the inert gas mixture.

After the inert gas mixture has passed through the heat management system 26, the inert gas mixture may pass through a final orifice 32, which reduces the pressure of the inert gas mixture relative to the pressure in the combustion chamber 4. The inert gas mixture may then pass through a second diffuser plate 34 to uniformly disperse the inert gas mixture throughout the space. As discussed hereinabove, flow diverters or other structures may also be used to direct to the flow of gas in a desired manner as it exits the fire suppression system 2. Again, since the inert gas mixture is generated pyrotechnically, high-pressure gas storage tanks and accompanying hardware to disperse the inert gas mixture may not be needed in the fire suppression system 2 of the present invention.

Figure 8:
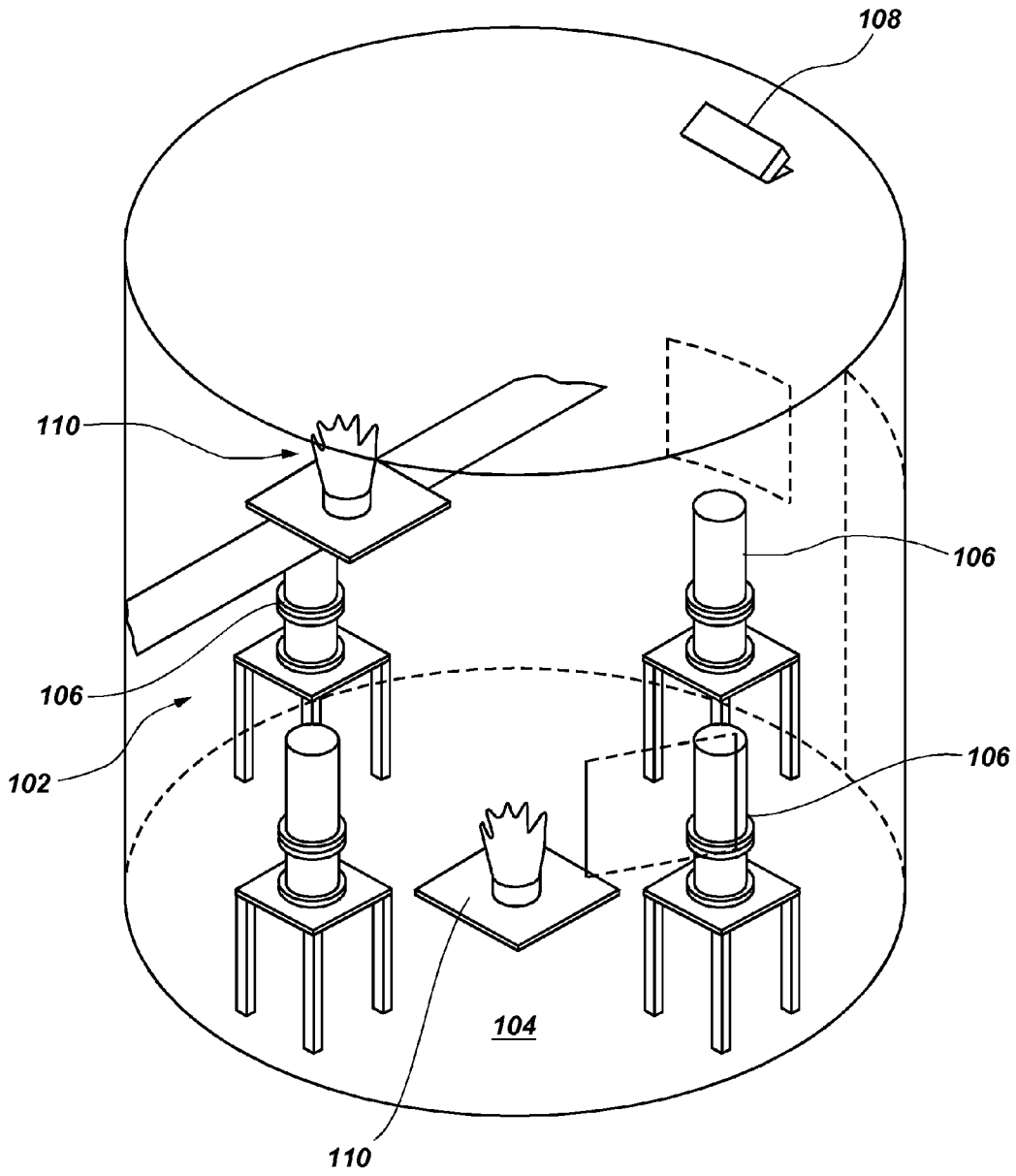
FIG. 8 is a perspective view of a fire suppression system as utilized in a defined space in accordance with one embodiment of the present invention.

Referring now to FIG. 8 in conjunction with FIGS. 1, 2 and 4, an example of a fire suppression system 102 is shown as used in a defined space 104 that exhibits a volume of approximately 1,000 cubic feet. The system includes four towers 106 spaced apart from one another throughout the defined space 104. One or more vents 108 may be provided in the defined space 104 to accommodate the venting of overpressures which may occur during the combustion of gas generants 8. A total cross sectional vent area of 288 square inches was used in the presently described embodiment. In testing the system 102, fires 110 were provided at one or more locations within the defined space 104.

In the presently described embodiment, each tower 106 includes a single fire suppression system 2 such as, for example, has been described with respect to FIGS. 1 and 2. After the fire 110 was ignited and allowed to burn for a predetermined time, the generators 70 were sequentially ignited such that the gas generants 8 were combusted at desired intervals. In the present embodiment, 152.5 cubic inches of generant per generator 70, 610 cubic inches of generant per single fire suppression system 2 were used. The generant included a composition having 78% HACN (unrecrystallized and containing less than 0.1% activated charcoal obtained from Autliv), 18% Chemet UP13600FM cupric oxide, 2% DeGussa P-25 titanium dioxide, 1% Cytec Cyanamer N-300 polyacrylamide and 1% 1/32" Fiber Glast #38 glass fibers. In the presently considered embodiment, the gas generants 8 of the generators 70 were ignited at intervals of approximately 1.5 to 2.5 seconds. The sequential ignition of individual gas generants 8 provided a moderated flow of gas over a desired time period while preventing unacceptable temperatures and unacceptable levels of over pressurization within the defined space 104.

Figure 9A:
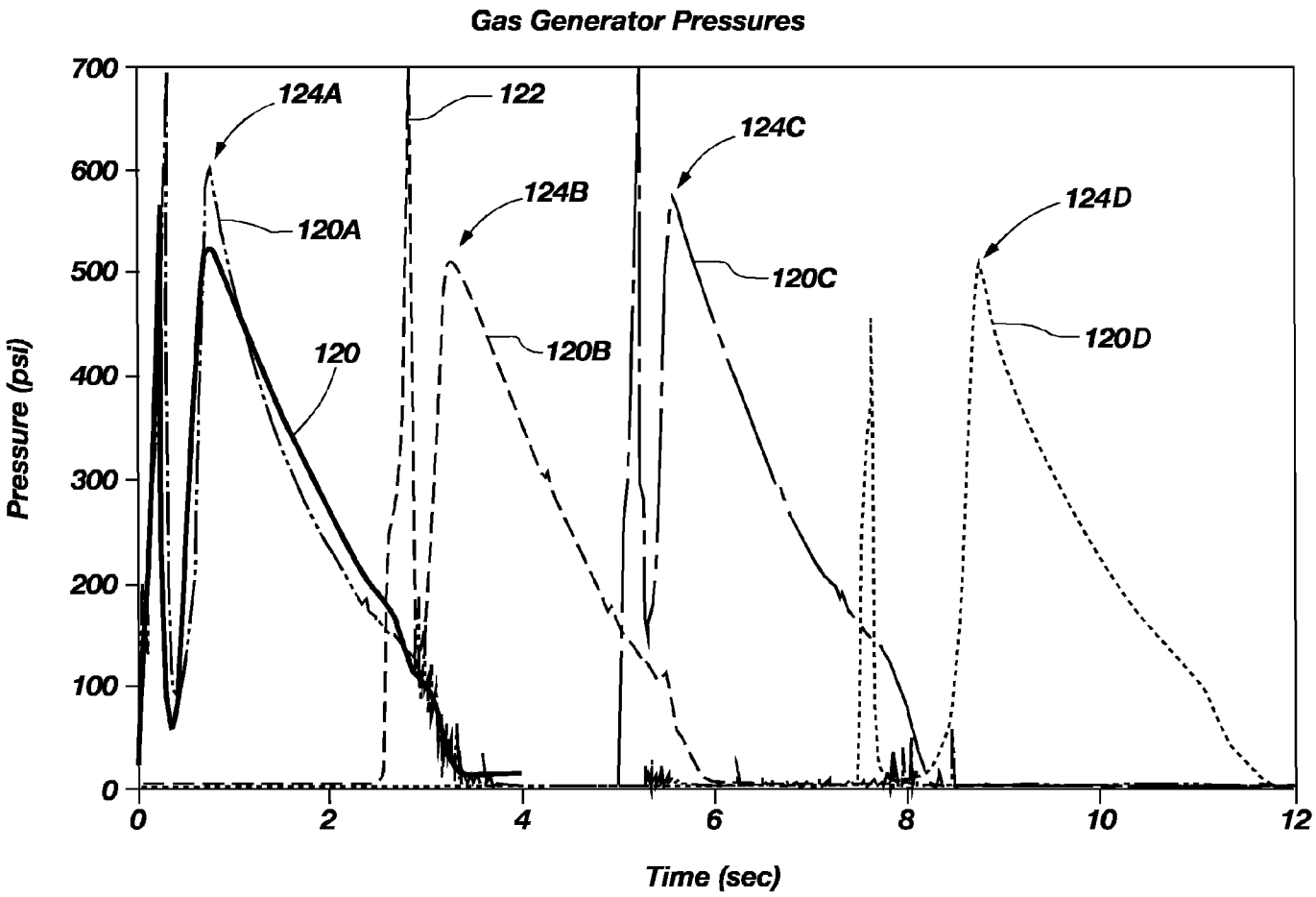
FIGS. 9A through 9E are graphs showing various performance characteristics associated with the operation of the system shown in FIG. 8.

For example, referring to the graph shown in FIG. 9A the pressure developed within each generator 70 (i.e., within the combustion chamber 4) is shown as a function of time. A thick line 120 shows the predicted pressure curve of a gas generator 70, while pressure curves 120A-120D show actual pressure curves associated with the sequential firing of the generators 70 within the towers 106 at approximately 2.5 second intervals. It is noted that the spikes (e.g., spike 122) in the pressure curves are associated with an initial ignition event, and can be reduced by altering the design of the associated ignition train. Discounting the ignition spikes 122, the peak or maximum combustion pressures 124A-124D are seen to be maintained between approximately 500 psi and approximately 600 psi.

Figure 9B:
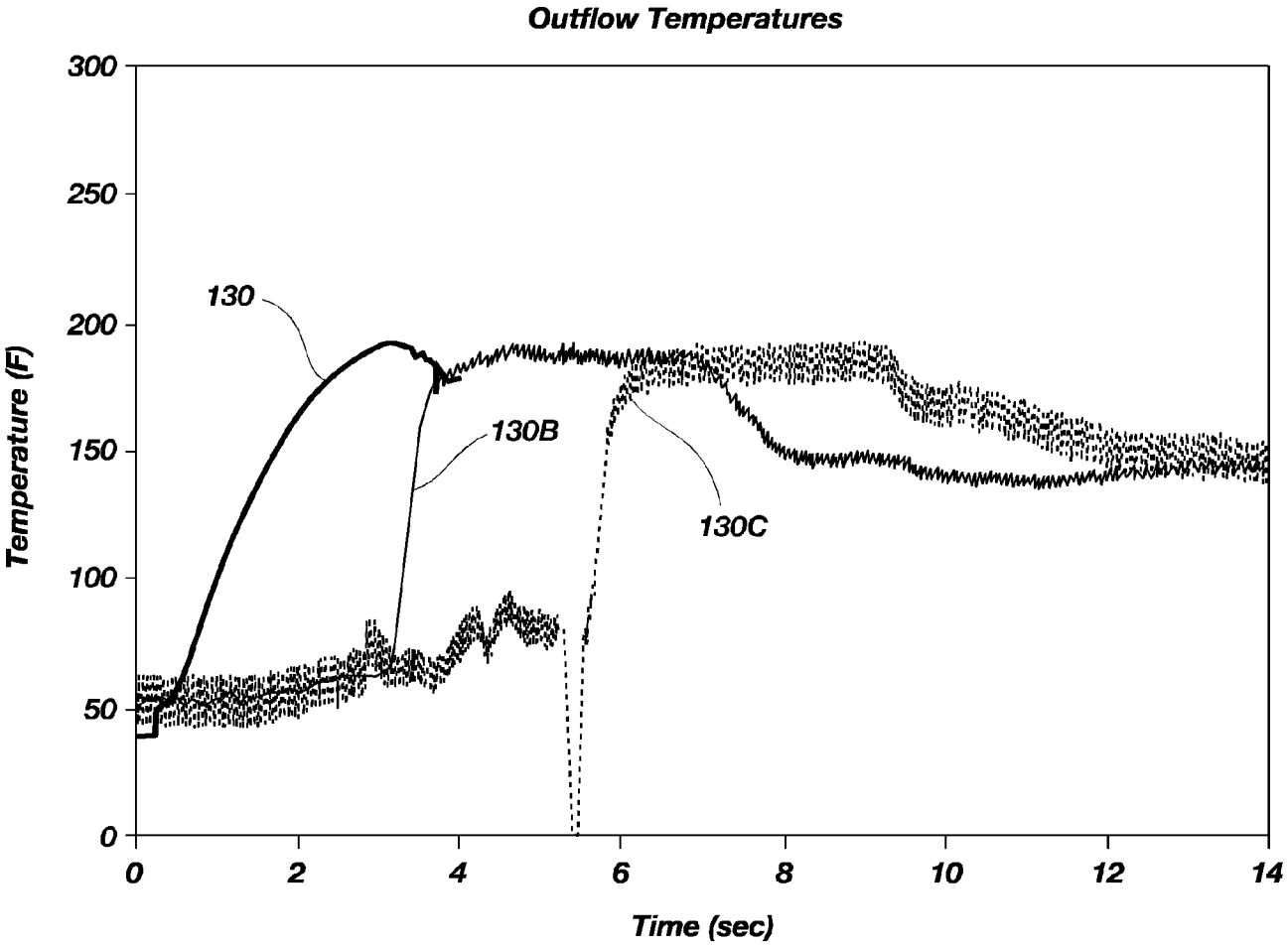

Referring to FIG. 9B, a graph is shown of the outflow temperatures from the second and third sequentially ignited gas generators 70 with respect to time. First curve 130 shows a predicted outflow temperature curve while curves 130B and 130C show the actual temperature curves. It is noted that the peak outflow temperature was maintained between approximately 150° F. and 200° F.

Figure 9C:
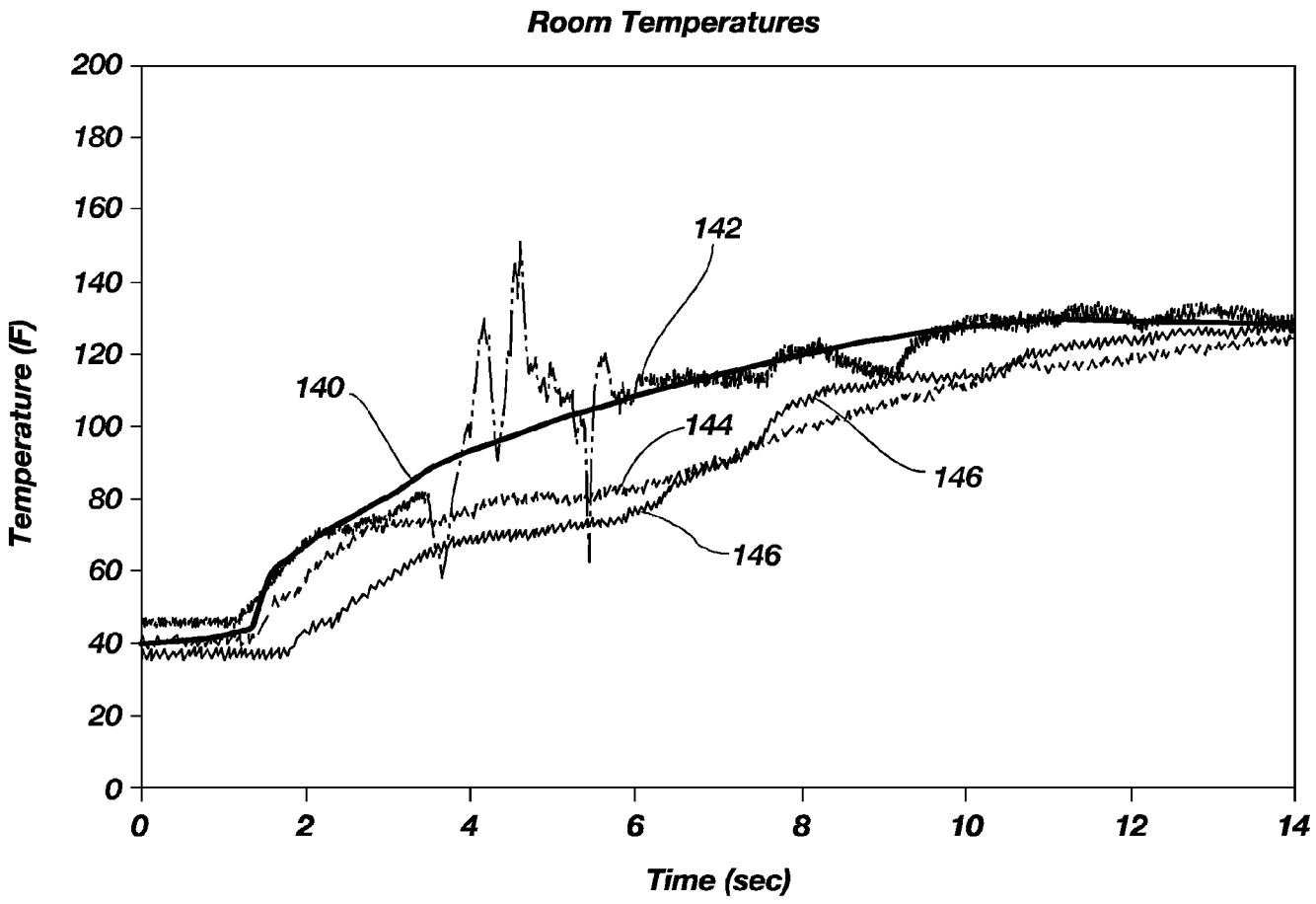

Referring to FIG. 9C, a graph is shown of the temperature of the room or defined space 104, at various locations within the room, with respect to time. First curve 140 is the predicted temperature within the defined space 104. Curve 142 represents the temperature of the defined space 104 at an upper elevation thereof. Curve 144 represents the temperature of the defined space 104 at a mid elevation thereof. Curve 146 represents the temperature of the defined space 104 at a lower elevation thereof. Temperatures of the room peaked at approximately 120° F. and 130° F.

Figure 9D:
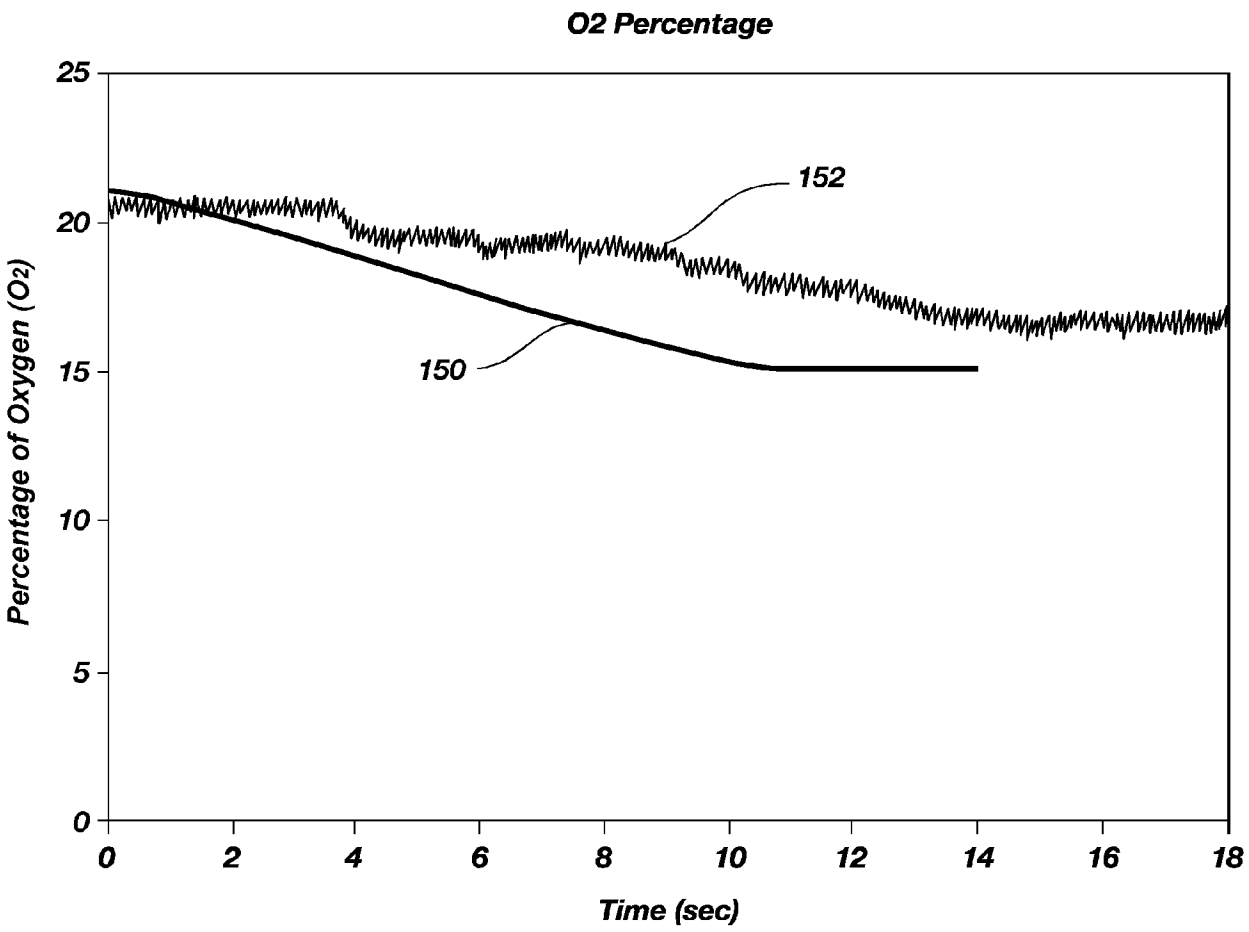

Referring to FIG. 9D, a graph is shown of the percentage of oxygen ($O_2$) within the defined space with respect to time. Curve 150 shows the predicted percentage of $O_2$ within the defined space 104 while curve 152 shows the actual percentage of $O_2$ measured within the defined space 104. The actual $O_2$ content of the air within the defined space 104 dropped several percent during the sequential ignition of the gas generators 70.

Figure 9E:
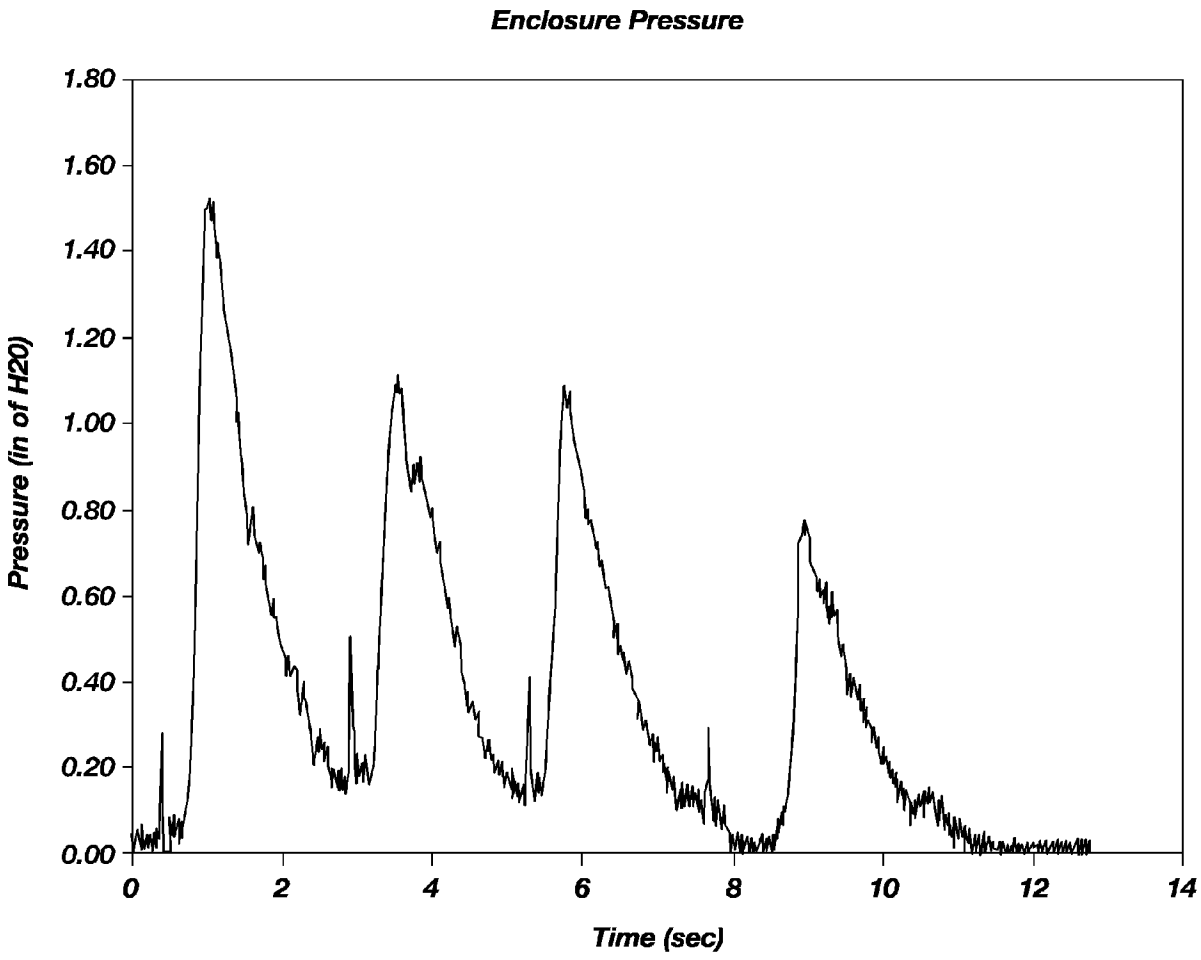

Referring now to FIG. 9E, the change in pressure within the defined space 104 is shown with respect to time during the sequential ignition of the gas generators 70. As may be seen in FIG. 9E, the change in pressure is less than approximately 1.6 inches of water (in $H_2O$) or approximately 0.06 psi.

It is noted that, in other embodiments, each of the towers 106 may include multiple gas generators 70, such as has been described with respect to the towers depicted in FIG. 4. In such a case, each individual gas generator 70 could be sequentially ignited. In other embodiments, other patterns of ignition may be used. For example, two (or more) gas generators could be ignited at substantially the same time followed by the time-spaced ignition of two (or more) additional generators. Additionally, the gas generators could be ignited not only in a time-based pattern, but in a specified geometrical or spatial pattern (e.g., clockwise, counterclockwise, a crossing or star pattern or a zig-zag pattern) to provide a desired mass flow pattern within the defined space 104. Thus, various time-based and spatial patterns may be utilized depending, for example, on the configuration of the defined space and the type and volume of gas generant 8 being utilized.

The following are examples of gas generant compositions and igniter compositions for use within the scope of the present invention. These examples are merely illustrative and are not meant to limit the scope of the present invention in any way.

EXAMPLES

Example 1

A HACN Gas Generant Produced Using a Slurry Reactor

A gas generant including HACN, BCN, and $Fe_2O_3$ was produced in the slurry reactor. A 10 liter baffled slurry tank was filled with 4,900 grams of distilled water and stirred with a three blade stationary impeller at 600 revolutions per minute ("rpm"). A glycol heating bath was used to heat the water to 180° F. After the water temperature reached 180° F., 586.1 g of technical grade HACN was added to the mixer and stirred at 600 rpm for 10 minutes to allow the HACN to dissolve. 111.64 g of BCN and 18.56 g of $Fe_2O_3$ were dry blended together in a NALGENE® quart container. 100 g of distilled water was then added into the blended BCN/$Fe_2O_3$ and stirred for 5 minutes until an even suspension was made. 58 g of this suspension of BCN/$Fe_2O_3$/water was then injected slowly into the mix bowl with a 30 cc syringe while mixing rapidly. The slow addition of solid into the mix bowl allows for better oxidizer distribution in the mix. The heating system of the mix bowl was then turned off and the system was cooled at 1.4° F./minute by melting ice on the exterior of the mix bowl. When the mix temperature reached 160° F., a second addition of 58 g of BCN/$Fe_2O_3$/water was injected slowly into the mix bowl with a 30 cc syringe while mixing rapidly. Cooling with ice was continued after this addition. When the temperature reached 139.7° F., a third addition of 58 g of BCN/$Fe_2O_3$/water was then injected slowly into the mix bowl with a 30 cc syringe while mixing rapidly. Cooling with ice was continued after this addition. When the temperature reached 119.9° F., 56.2 g (the remainder of the suspension) of BCN/$Fe_2O_3$/water was injected slowly into the mix bowl with a 30 cc syringe while mixing rapidly. Cooling with ice was continued after this addition until the temperature reached 75.4° F. At that time, the impellar was stopped and the material was transferred out of the mix bowl and into a five-gallon bucket. The mix was then filtered in a vacuum Erlenmeyer flask with a 1-μm paper filter. The mixed gas generant was then placed onto a glass tray and dried at 165° F. overnight to remove any moisture.

Example 2

A HACN Gas Generant Produced by Vertical Mixing

A five-gallon BAKER PERKINS® vertical mixer was filled with 10,857 g of distilled water and stirred at 482 rpm. The mix bowl was heated to 165° F. After the water temperature reached 165° F., 3,160.0 g of recrystallized HACN was added into the mixer and stirred slowly at 482 rpm for 15 minutes to allow the HACN to partially dissolve and break up any clumps. 1,800 g of $Cu_2O$ and 720 g of $TiO_2$ were then dry blended by sealing a five-gallon bucket and shaking it. The mixer was stopped and the walls and blades were scraped down to incorporate any material that may have migrated up the mix blades. Then, the blend of $Cu_2O$ and $TiO_2$ was added to the mix bowl and mixed for 15 minutes at 482 rpm. The mixer was stopped and the walls and blades were scraped down to incorporate any material that may have migrated up the mix blades. Then, 3,160 g of recrystallized HACN was added into the mix bowl and mixed for 15 minutes at 482 rpm. The mixer was stopped and the walls and blades were scraped down. The mixture was mixed for 30 minutes at 1,760 rpm. The mixer was stopped and the walls and blades were scraped. Then, the mixture was mixed for 30 minutes at 1,760 rpm. The mixture was loaded onto velo-stat-lined trays and dried at 165° F. After drying, the coarse, granular material was granulated to a consistent small granule size using a Stokes granulator.

Example 3

A HACN Gas Generant with Organic Binder Produced by Vertical Mixing

To a one-gallon BAKER PERKINS® vertical mixer, 2,730 g of recrystallized HACN and 35 g of granular Cytec Cyanamer N-300 polyacrylamide were added. The two solids were blended for two minutes, after which 1,750 g of deionized water was added. The resulting slurry was mixed for 15 minutes. The mixer was stopped and the walls and blades were scraped down to incorporate any material that may have migrated up the mix blades.

In a two-gallon plastic container with a snap-on lid, 630 g of American Chemet Corp. UP13600FM cupric oxide and 105 g of DeGussa P-25 titanium dioxide were preblended by vigorous shaking. Then, the blend of cupric oxide and titanium dioxide was added into the mix bowl and mixed for 5 minutes. The mixer was stopped and the walls and blades were scraped down to incorporate any material that may have migrated up the mix blades. The resulting paste was then mixed for an additional 15 minutes. The mixture was loaded into glass baking dishes and dried at 165° F. with occasional stirring. After drying, the coarse granular material was granulated to −12 mesh using a Stokes granulator.

Example 4

A HACN Gas Generant Produced in a Rotating Double-Cone Dryer

To a two cubic foot rotating double-cone dryer, 2,996 g of cupric oxide and 817 g of titanium dioxide were added. The material was blended for 20 minutes by way of rotation of the rotating double-cone dryer. Afterwards, the inside walls of the rotating double-cone dryer were scraped down to free any unblended material. Next, 23,426 g of recrystallized HACN was added to the rotating double-cone dryer. The material was blended for an additional thirty minutes and then collected.

Example 5

A HACN Gas Generant Containing an Organic Binder Produced in a Muller Mixer

A polymer preblend was prepared by mixing 82 g of Crompton Corp. Fomrez F17-80 polyester resin with 17.4 g of Vantico Inc. Araldite MY0510 multifunctional epoxy resin and 0.6 g of powdered magnesium carbonate. To a 12" diameter muller mixer, 10 g of the polymer preblend and 1,636 g of recrystallized HACN were added. This was blended for 10 minutes and the mixing surfaces were scraped down. Then, 294 g of American Chemet Corp. UP13600FM cupric oxide and 60 g of DeGussa P-25 titanium dioxide were added and the composition was mixed for 5 minutes. The mixer was again scraped down and the composition was blended for another 10 minutes. The composition was placed in a freezer and allowed to warm to room temperature immediately before pressing it into a pellet.

Example 6

Test Article Pellet Pressing

Pellets formed from the gas generants described in Examples 1, 2, or 4 were produced. To press the pellets, a 1.13 inch die assembly was used. A mold release agent, polytetrafluoroethylene ("PTFE"), was liberally applied to the die anvil and foot to minimize material sticking during the press cycle. 1.5 g of an igniter composition having a mixture of 60% B/$KNO_3$ and 40% Mg/$Sr(NO_3)_2$/binder was added to the die and leveled off with a spatula. The igniter composition was produced by blending together granules of the B/$KNO_3$ and Mg/$Sr(NO_3)_2$/binder. 10 g of the gas generant described in Examples 1, 2, or 4 was added to the die. The press foot was inserted into the top of the die assembly and twisted to ensure proper alignment. The pellet was pressed for 60 seconds at 8,000 $lb_f$ (8,000 psi). After pressing, the anvil was removed from the assembly and the pellet was pressed out of the die into a padded cup to minimize damage.

Example 7

Sleeved Test Article Pellet Pressing

Sleeved pellets formed from the gas generants described in Examples 1, 2, or 4 were produced. The press anvil and foot of the die were liberally sprayed with PTFE. A 1.05 inch internal diameter ("ID") steel ring was placed on the press anvil. 1.2 g of an igniter composition having a mixture of 60% $B/KNO_3$ and 40% $Mg/Sr(NO_3)_2$/binder was then added inside the steel ring. The surface of the igniter composition was then leveled with a spatula to ensure an even layer of the igniter composition on one surface of the pellet. An alignment sleeve was placed on top of the steel sleeve and 14.5 g of the gas generant described in Examples 1 or 2 was poured inside the alignment tool. A 1.00 inch outer diameter ("OD") press foot was inserted into the die. The sleeved pellet was pressed for 60 seconds at 6,900 $lb_f$ (8,000 psi). After pressing, the top surface of the sleeved pellet matched the top layer of the steel ring. Therefore, no post pressing process was required to remove the pellet from the press die. Instead, the anvil and alignment piece pulled off easily, leaving a filled steel ring of the gas generant.

Example 8

Sleeved Test Article Pellet Pressing with Hot Wire

Sleeved pellets were also pressed with embedded hot wires by running a loop of tungsten wire having a 0.010 inch OD through two holes on the press anvil. The wire leads were rolled up and stored in the labeled opening on the underside of the press anvil. After installing the hot wire in the pressing fixture, the procedure for sleeved pellets (described in Example 7) was followed.

Example 9

5.8 Inch Diameter Test Pellets 3.3 pound pellets were pressed using a 150-ton hydraulic press. The anvil and press foot were sprayed liberally with PTFE. The anvil was then inserted into the die walls. 39.6 g of the igniter composition (40% $B/KNO_3$ and 60% $Mg/Sr(NO_3)_2$/binder) was added to the die by slowly pouring the material in a circular coil pattern starting at the center of the anvil and moving outward toward the die wall. The igniter composition was then leveled on top of the press anvil with a spatula. After ensuring an even layer of the igniter composition, 1,500 g of the gas generant described in Examples 1, 2, or 4 was added to the die. The press foot was then carefully inserted into the die. To ensure proper alignment, the press foot was spun around to ensure that no gas generant was trapped between the die walls and press foot. After alignment, the pellet was pressed at 211,000 $lb_f$ (8,000 psi) for 60 seconds. To remove the pellet, the press anvil was removed and the die walls were positioned on top of a 6.0 inch inner diameter ("ID") knockout cup. A slight amount of force was applied to the press foot to push the pellet out of the 5.8 inch die walls.

Example 10

Test Pellets Pressed in a Steel Can

The gas generant (737 g) described in Example 4 was added to a carbon steel can having an OD of 6.0 inches, an ID of 5.8 inches, a height of 2.15 inches, and a depth of 2.06 inches and pressed using a 150-ton hydraulic press to a maximum pressure of 8,042 psi. Pressure was maintained at or above 8,000 psi for one minute. A second addition of 740 g of the gas generant was added to the press die along with a 59.4 g blend of an igniter composition that included 11% $B/KNO_3$ and 89% $Mg/Sr(NO_3)_2$/binder. The igniter composition was spread evenly on the top surface of the gas generant. The remaining gas generant and the igniter composition were then pressed at 8,197 psi for one minute. The total height of the gas generant and igniter composition after the final press cycle was 2.01 inches.

Example 11

Subscale Fire Suppression System

A subscale system of the fire suppression system 2 was produced, as shown in FIG. 2. The gas generant 8 used in the subscale system included a composition of HACN, $Cu_2O$, and $TiO_2$, which was prepared as previously described. The igniter composition 14 included 1 g of 60% $B/KNO_3$ and 40% $Mg/Sr(NO_3)_2$/binder. The subscale system included an igniter cover 36, an inner case 40, an outer case 42, a base 44, a perforated tube 46, a screen retainer 48, a cover fabrication 50, an inner barrier 52, a tie rod 54, a perforated baffle 56, a boss 58, and a baffle 60. An inhibitor 62, formed from Krylon/Tape, was applied to the bottom of the gas generant pellet 16, which came in contact with a spacer 64 in the combustion chamber 4. In addition to providing heat management properties, the perforated tube 46 prevents the escape of particulates from the ignition chamber.

Figure 5:
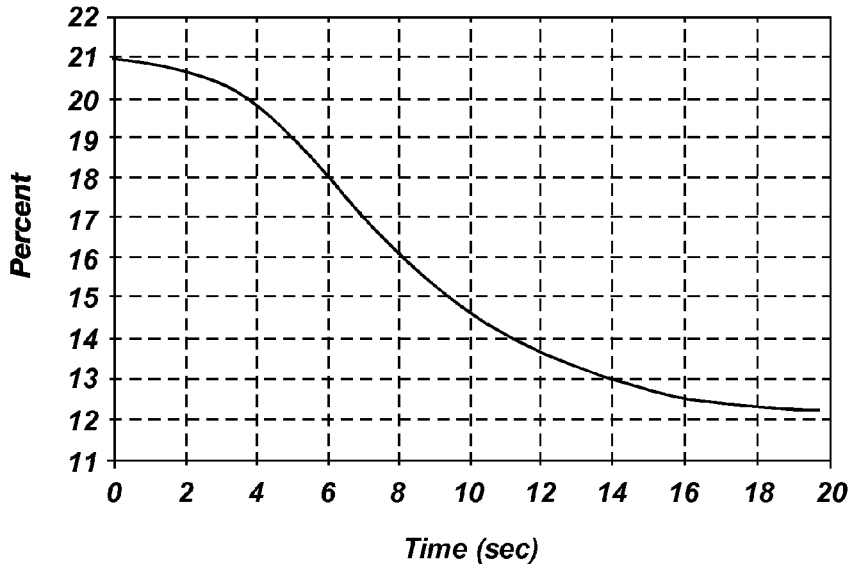
FIG. 5 shows the calculated mole percent of oxygen in a 100 cubic foot room.

The mass of the gas generant 8 in the fire suppression system 2 was selected so that when the inert gas mixture was vented into a 100 cubic foot enclosure, atmospheric oxygen was displaced and removed to a level low enough to extinguish combustion in the enclosure. A 3.3 lb pellet having the gas generant 8 was used in the subscale system. Upon combustion of the pellet, the oxygen content in the 100 cubic foot enclosure was reduced to below approximately 13% oxygen, as shown in FIG. 5.

Figure 6:
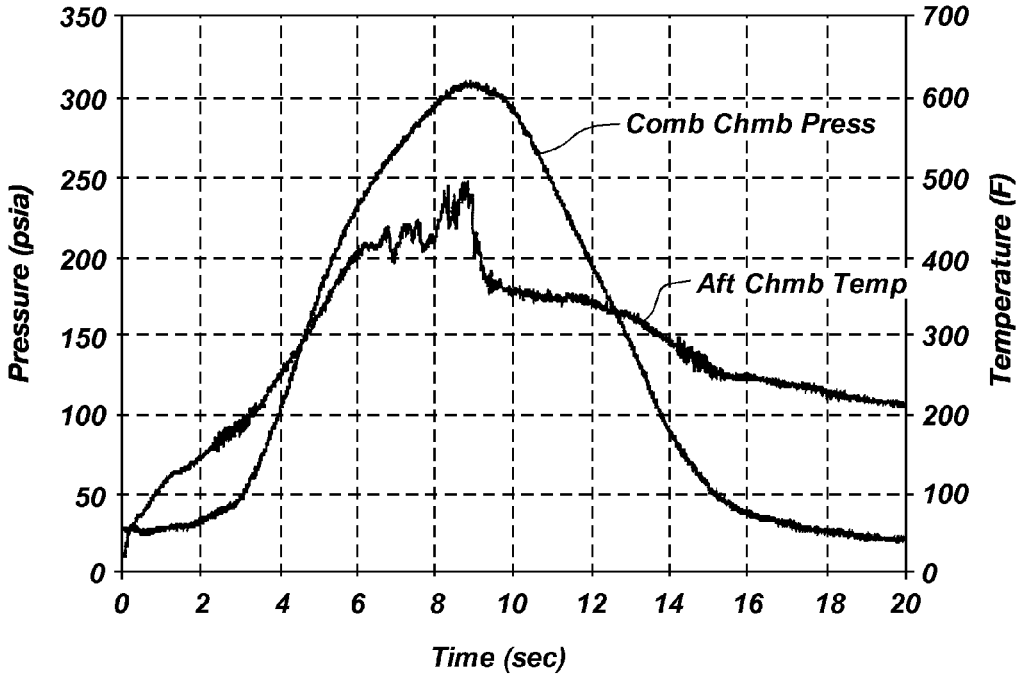
FIGS. 6 and 7 show pressure and temperature traces of Test A and Test B.

In test A, a cylindrical pellet 16 was tested. The pressure generated in the combustion chamber 4 and the temperature of the gas in the aft of the combustion chamber 4 were measured. As shown in FIG. 6, the maximum pressure in the fire suppression system 2 was slightly more than 300 psi at approximately 9 seconds after ignition of the gas generant 8. The maximum temperature in the fire suppression system 2 was less than 500° F. at approximately 9 seconds after ignition of the gas generant 8.

Figure 7:
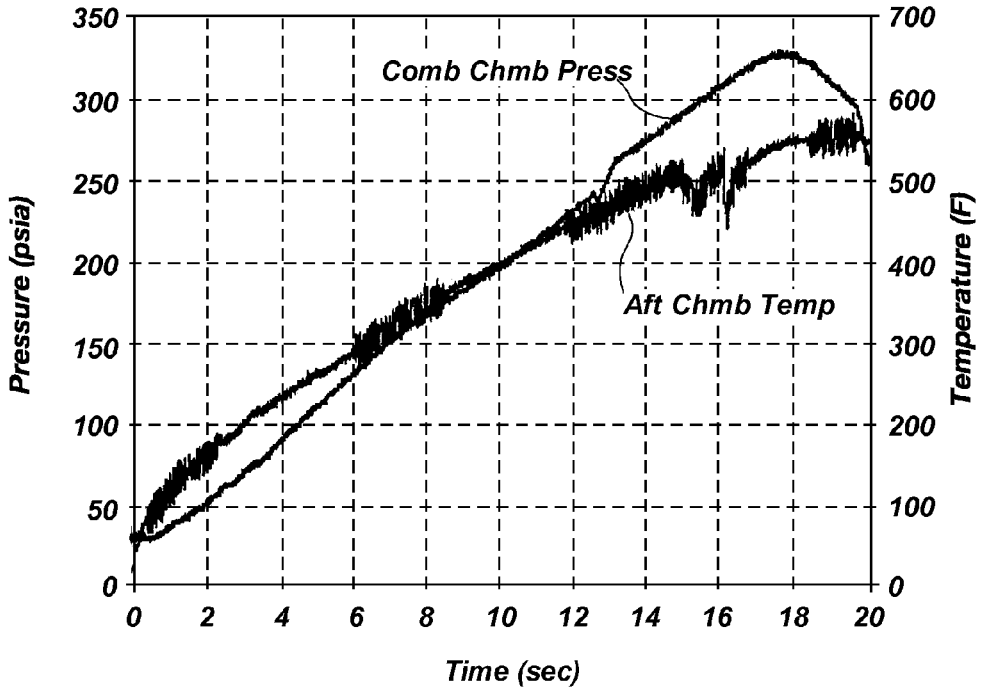

In test B, a cylindrical pellet that was pressed into a metal cylinder and inhibited on one end was tested. As shown in FIG. 7, the maximum pressure in the fire suppression system 2 was approximately 650 psi at approximately 18 seconds after ignition of the gas generant 8. The maximum temperature in the fire suppression system 2 was less than approximately 550° F. at approximately 19 seconds after ignition of the gas generant 8.

Example 12

Mini-Generator Test

A mini-generator developed for use in airbag research was used to test pellets of the igniter composition 14 and gas generant 8 described in Examples 6 or 7. The mini-generator is a conventional device that consists of reuseable hardware and is a simplified prototype of a driver-side airbag inflator.

Pellets 16 having a mass of from approximately 20 g to approximately 25 g were ignited in the mini-generator. The gaseous combustion products (or effluent gases) of the pellets 16 were transferred into gas-impermeable bags and tested to determine the contents of the gaseous combustion products. The gaseous combustion products were tested using a conventional, colorimetric assay, i.e., the Draeger Tube System, which is known in the art. In the mini-generator, CO levels decreased from 2,000 parts per million ("ppm") to 50 ppm. $NO_x$ levels decreased from 2,000 ppm to 150 ppm. In addition, a tough, unitary slag was produced.

Example 13

100 Cubic Foot Tank Test

The pellets 16 described in Example 10 were tested in the subscale fire suppression system described in Example 11, which was attached vertically to an assembly plate near the bottom of a 100 cubic foot test tank equipped with pressure transducers, thermocouples, a video camera, and an oxygen sensor. The tank was designed with a vent to eliminate significant overpressure. A Thiokol ES013 squib was electronically activated and the hot effluents produced by the squib ignited 6 grams of $B/KNO_3$ in the ignition chamber, which in turn ignited the igniter composition 14 that was pressed onto the top surface of the gas generant 8. The igniter composition 14 then ignited the gas generant 8. The pressure in the combustion chamber 4 reached a maximum pressure of 650 psi in about 18 seconds. The pressure in the combustion chamber 4 decreased to 50 psi 25 seconds after ignition. Maximum pressure in the 100 cubic foot tank was 0.024 psig. After the test, ammonia, carbon monoxide, $NO_x$, and nitrogen dioxide were measured using appropriate Draeger tubes at 48 ppm, 170 ppm, 105 ppm and 9 ppm, respectively.

Example 14

Use of Igniter Composition Placed on the Surface of the Gas Generant Grain

A pellet 16 was pressed into a can similarly to that described in Example 10, except that the igniter composition 14 was not pressed onto the top surface of the gas generant 8. When the resulting pellet 16 was tested in the subscale fire suppression system described in Example 11, the Thiokol ES013 squib ignited 1 g of $B/KNO_3$ in the ignition chamber which, in turn, ignited a 59.4 g blend of the igniter composition (11% $B/KNO_3$ and 89% $Mg/Sr(NO_3)_2$/binder) assembled in an aluminum foil packet placed on the top surface of the gas generant 8. Ignition was enhanced over that obtained in Example 13 because the maximum pressure of 900 psi in the combustion chamber was reached at 16 seconds after ignition.

Example 15

Use of Flaked Copper-Containing Metals as an Ignition Aid

Two 10 g, 1.1-OD cylindrical pellets 16 were pressed at 8,000 psi. One pellet 16 included the gas generant 8 described in Example 4. The other pellet 16 included 90% by weight of the gas generant 8 described in Example 4 blended with 10% by weight of Warner-Bronz finely divided bronze flakes, produced by Warner Electric Co., Inc. On the top surface of each pellet 16, 0.5 g of granular $Mg/Sr(NO_3)_2$/binder was present. The igniter composition 14 on each pellet 16 was ignited by a hot wire. The pellet 16 that included the finely divided bronze flakes ignited more smoothly, combusted more rapidly, and produced a stiffer slag once combusted compared to the pellet 16 without the finely divided bronze flakes.

Example 16

Evaluation of Binders in HACN Gas Generants (Small Scale)

HACN gas generant compositions were mixed similarly to those described in Examples 2, 3, 4, and 5. For each composition, three 0.5 inch diameter, 4.0 g pellets were pressed at 2,000 lb force for 20 seconds. In addition, three 1.1 inch diameter, 15.0 g pellets were pressed at 10,000 lb force for 20 seconds. The pellets were analyzed for crush strength at a 0.125 in/min compression rate. The 0.5 inch pellets were used to determine axial crush strength and the 1.1 inch diameter pellets were analyzed for radial crush strength. The data are summarized in Table 1 and show that pellets 16 having the organic binder or inorganic binder had improved axial crush strength compared to those compositions having no binder. In addition, many of the pellets 16 had improved radial crush strength compared to those compositions having no binder.

TABLE 1

Crush Strength of HACN Gas Generants[a] as a Function of Binder.

| Binder | % HACN | % CuO | Mix Method (Ex. #) | Pellet Density (g/cc) | Axial Crush Strength (lb) | Radial Crush Strength (lb) |
|---|---|---|---|---|---|---|
| None | 86.0 | 11.0 | 4 | 1.751 | 319 | 65 |
| None | 86.0 | 11.0 | 2 | 1.753 | 296 | 123 |
| 0.5% cured polyester | 81.8 | 14.7 | 5 | 1.841 | 417 | 121 |
| 1.0% cured polyester | 77.7 | 18.3 | 5 | 1.900 | 610 | 182 |
| 2.0% cured polyester | 69.3 | 25.7 | 5 | 2.020 | 795 | 253 |
| 3.0% cured polyester | 61.0 | 33.0 | 5 | 2.17 | 1059 | 365 |
| 2.0% guar | 74.5 | 20.5 | 5 | 1.812 | 757 | 178 |
| 1.0% polyacrylamide | 78.0 | 18.0 | 4 | 1.751 | 507 | 220 |
| 1.5% polyacrylamide | 74.1 | 21.4 | 4 | 1.789 | 574 | 210 |
| 2.0% polyacrylamide | 70.1 | 24.3 | 4 | 1.819 | 586 | 245.7 |
| 1.5% copolymer[b] | 78.0 | 17.5 | 4 | 1.792 | 672 | 232 |
| 4.0% guanidine nitrate | 79.2 | 13.8 | 4 | 1.762 | 373 | 149 |
| 1.0% ethyl cellulose | 77.0 | 19.0 | 4 | 1.836 | 609 | 181 |
| 1.5% cured silicone | 71.4 | 23.8 | 5 | 1.949 | 336 | 46 |
| 2.5% sodium silicate | 84.1 | 10.4 | 4 | 1.725 | 403 | 217 |

[a]All formulations include 3% titanium dioxide.

[b]The copolymer includes 90% sodium acrylate and 10% acrylamide monomers, respectively.

Gas-generator hardware larger in scale than that used in Example 17 was used to test 1.42 inch diameter pellets 16 of formulations selected from Table 1. The 1.42 inch diameter pellets were produced by pressing 58.0 g of the gas generant at 16,000 lb force for 60 seconds. Behind a protective shield, a hole was drilled into the center of each of the pellets 16 using a 0.3015 inch OD drill bit to produce a center-perforation in the pellets. The gas generator hardware was attached to a 60-liter tank. The pellets were then ignited and combustion analyses were performed on the gaseous combustion products. After combustion, dilution of the air in the 60-liter tank by combustion gases produced by the gas generant 8 was sufficient to decrease oxygen content in the tank to approximately 13%. Results of these combustion analyses are summarized in Table 2.

TABLE 2

Combustion Analysis of Small Center-Perforated Gas Generant Pellets

| Binder | Test Info[1] | Pellet Density (g/cc) | Maximum Pressure (psi) | Rise Time (sec) | $NH_3$ (ppm) | $NO_x$ (ppm) | CO (ppm) | $NO_2$ (ppm) |
|---|---|---|---|---|---|---|---|---|
| dry blended, no binder | 1a | 1.664 | 690.4 | 1.10 | 7 | 55 | 230 | 17 |
| dry blended, no binder | 2a | 1.728 | 688.5 | 2.16 | 86 | 85 | | 12 |
| wet mixed, no binder | 1a | 1.668 | 584.0 | 1.28 | 85 | 80 | 220 | 17 |
| 1% polyacrylamide | 1a | 1.764 | 402.3 | 2.21 | 5 | 105 | 850 | 60 |
| 1% polyacrylamide | 2a | 1.762 | 528.3 | 1.00 | 83 | 90 | 850 | 28 |
| 2% guar | 1b | 1.674 | 637.7 | 0.92 | 170 | 55 | 1900 | 2 |
| 1% cured polyester | 1a | 1.875 | 800.8 | 1.50 | 40 | 85 | 680 | 60 |
| 1% ethyl cellulose | 1a | 1.829 | 390.6 | 1.97 | 10 | 150 | 1200 | 85 |
| 1% copolymer[2] | 1a | 1.769 | 254.9 | 3.76 | 23 | 300 | 1200 | 150 |
| 4% guanidine nitrate | 2a | 1.737 | 752.9 | 1.05 | 58 | 70 | 1700 | 12 |
| 2.5% sodium silicate | 2b | 1.706 | 1299.8 | 11.63 | 340 | 125 | 380 | 40 |
| 1.5% silicone | 2a | 1.945 | 1391.6 | 10.14 | | | 1100 | |

[1]Signifies the use of 1 g of $B/KNO_3$ in the ignition chamber, 1 g of $Mg/Sr(NO_3)_2$/binder in an aluminum foil packet on top of the pellet, and 1 g of $Mg/Sr(NO_3)_2$/binder in the pellet's center perforation; [2]Signifies the use of 1 g of $B/KNO_3$ in the ignition chamber and 2 g of $Mg/Sr(NO_3)_2$/binder in an aluminum foil packet on top of the pellet; (a) Signifies the combustion chamber limiting orifice diameter of 0.086"; (b) Signifies an orifice diameter of 0.0785".
[2]The copolymer includes 90% sodium acrylate and 10% acrylamide monomers, respectively.

Example 17

Evaluation of Binders in HACN Gas Generants (Larger Scale)

Larger, center-perforated pellets were fabricated by pressing 1,520 g of the HACN gas generant 8 in a 5.8" diameter die at 8,000 psi for a minimum of 1 minute. Once the pellets were pressed, a 1.25" diameter drill bit was used to produce a center perforation in the pellets. The pellets were tested in fire suppression system 2 as illustrated in FIG. 2 using the 100 cubic foot tank test described in Example 13. The ignition train utilized an ATK Thiokol Propulsion ES013 squib, 2 g of $B/KNO_3$ in the ignition chamber and 50 g of $Mg/Sr(NO_3)_2$/binder igniter composition in a foil packet placed on top of the center-perforated pellet. The pellets were then ignited and combustion analyses were performed on the gaseous combustion products. The combustion analyses are summarized in Table 3. Measured toxic gaseous effluent levels were generally lower in the larger scale tests compared to those in the small scale tests, which were described in Example 16.

TABLE 3

Larger Scale Gas Generant Combustion Analysis Tests[1].

| Binder | Limiting Orifice Diameter (in) | Pellet Density (g/cc) | Maximum Pressure (psi) | Rise Time (sec) | $NH_3$ (ppm) | $NO_x$ (ppm) | $CO_2$ (%) | CO (ppm) |
|---|---|---|---|---|---|---|---|---|
| dry blended, no binder | 9/32 | 1.792[2] | 913.0 | 2.70 | 35 | 33 | | 29 |
| wet mixed, no binder | 9/32 | — | 787.0 | 2.50 | 40 | 40 | | 23 |
| 0.5% cured polyester | 9/32 | 1.827 | 684.0 | 3.37 | 48 | 45 | 0.22 | 175 |
| 4.0% guanidine nitrate | 5/16 | 1.732 | 657.7 | | 18 | 42 | 0.32 | 300 |
| 4.0% guanidine nitrate | 5/16 | 1.719 | 553.7 | 3.33 | 35 | 47 | 0.28 | 300 |
| 1.0% polyacrylamide | 9/32 | 1.724 | 543.0 | 2.68 | 8 | 25 | 0.30 | 270 |
| 1.0% polyacrylamide | 9/32 | 1.727 | 542.0 | 2.50 | 7 | 23 | | 265 |
| 1.0% polyacrylamide using HACN co-crystallized with 0.9% charcoal (tech. grade HACN)[3] | 9/32 | 1.750 | 484.9 | 2.61 | 9 | 45 | | 840 |
| 0.5% polyacrylamide using tech. grade HACN[4] | 9/32 | 1.735 | 572.0 | 2.50 | 11 | 60 | 0.62 | 670 |

TABLE 3-continued

Larger Scale Gas Generant Combustion Analysis Tests[1].

| Binder | Limiting Orifice Diameter (in) | Pellet Density (g/cc) | Maximum Pressure (psi) | Rise Time (sec) | $NH_3$ (ppm) | $NO_x$ (ppm) | $CO_2$ (%) | CO (ppm) |
|---|---|---|---|---|---|---|---|---|
| 1.0% polyacrylamide using 50% tech. grade HACN[5] | 9/32 | 1.865 | 412.0 | 3.60 | 11 | 45 | 0.61 | 670 |

[1]Nitrogen dioxide was not detected in these tests using Draeger tubes and, thus, nitrogen dioxide is assumed to be less than 1 ppm. Unless noted otherwise, recrystallized HACN was used in the compositions tested.
[2]Pellet pressed at 11,000 psi.
[3]Formulation includes 71% tech. grade HACN, 25% cupric oxide and 3% titanium dioxide.
[4]Formulation includes 74.5% tech. grade HACN, 22% cupric oxide and 3% titanium dioxide.
[5]Formulation includes 37.2% carbon-free HACN, 37.2% tech. grade HACN, 21.6% cupric oxide and 3% titanium dioxide.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A fire suppression system comprising:

a plurality of gas generators positioned within a defined space where a fire is to be suppressed, each gas generator of the plurality of gas generators having a solid gas generant composition positioned within a combustion chamber, separate from any other combustion chamber of any other gas generator of the plurality of gas generators, the combustion chamber having walls capable of withstanding a maximum working pressure, and each gas generator of the plurality of gas generators configured to generate a flow of gas into the defined space upon ignition of its respective solid gas generant composition; and at least one initiating device configured to ignite each of the respective solid gas generant compositions of each gas generator of the plurality of gas generators, and to ignite the respective solid gas generant composition of at least one gas generator of the plurality of gas generators independent of ignition of the respective solid gas generant composition of at least one other gas generator of the plurality of gas generators in a predetermined, time-ordered sequence selected to achieve and substantially maintain pressure within a predetermined range within the defined space during gas generation during ignition of the at least one gas generator and the at least one other gas generator of the plurality of gas generators.

2. The fire suppression system of claim 1, wherein the plurality of gas generators is disposed within a common structure.

3. The fire suppression system of claim 1, wherein a first gas generator of the plurality of gas generators is disposed within a first structure, and wherein a second gas generator of the plurality of gas generators is disposed within a second structure.

4. The fire suppression system of claim 1, wherein, during operation, the solid gas generant composition of a first gas generator of the plurality of gas generators is ignited at a first time and the solid gas generant composition of a second gas generator of the plurality of gas generators is ignited at a second time approximately 1.5 seconds to approximately 2.5 seconds subsequent the first time.

5. The fire suppression system of claim 4, wherein, during operation, the solid gas generant compositions of any remaining gas generators of the plurality of gas generators are ignited at sequential intervals of approximately 1.5 seconds to approximately 2.5 seconds subsequent the second time.

6. The fire suppression system of claim 1, wherein the solid gas generant composition comprises hexa(ammine) cobalt(III)-nitrate (HACN) with less than approximately 0.1% charcoal.

7. The fire suppression system of claim 6, wherein the HACN is unrecrystallized.

8. The fire suppression system of claim 6, wherein the solid gas generant composition further comprises cuprous oxide ($Cu_2O$) and a polyacrylamide binder.

9. The fire suppression system of claim 8, wherein the solid gas generant composition further comprises a plurality of chopped fibers.

10. The fire suppression system of claim 1, wherein the solid gas generant composition is formed as at least one pellet having a first end surface and a second, opposing end surface, and wherein at least one surface feature is defined in the first end surface and configured to define an air gap between the first end surface and a structure disposed adjacent the first end surface.

11. The fire suppression system of claim 1, wherein the solid gas generant composition is substantially the same for each of the plurality of gas generators.

12. The fire suppression system of claim 1, wherein the plurality of gas generators is distributed in a spatial pattern within the defined space.

13. The fire suppression system of claim 1, wherein the plurality of gas generators has a quantity of solid gas generant composition selected to reduce the percentage of $O_2$ within the defined space to a predetermined range upon completion of gas generation.

14. The fire suppression system of claim 13, wherein the plurality of gas generators has a quantity of solid gas generant composition selected to reduce the percentage of $O_2$ within the defined space to a range of from about 10% to about 20% $O_2$ upon completion of gas generation.

15. The fire suppression system of claim 14, wherein the plurality of gas generators has a quantity of solid gas generant composition selected to reduce the percentage of $O_2$ within the defined space to a range of from about 13% to about 17% $O_2$ upon completion of gas generation.

16. A method of suppressing a fire in a defined space, the method comprising:

positioning a plurality of gas generators within the defined space, each gas generator of the plurality of gas generators comprising a separate pressure controlling orifice;

igniting a solid gas generant composition of each of the plurality of gas generators, to generate a flow of gas through the separate pressure controlling orifice of each gas generator of the plurality of gas generators and into the defined space from each of the plurality of gas generators independent of generation of gas by any other of the plurality of gas generators, and igniting the respective solid gas generant composition of at least one gas generator of the plurality of gas generators and the respective solid gas generant composition of at least one other gas generator of the plurality of gas generators in a predetermined time-based sequence to achieve and substantially maintain pressure within a predetermined range within the defined space during gas generation and to suppress a fire within the defined space throughout ignition of the at least one gas generator and the at least one other gas generator of the plurality of gas generators.

17. The method according to claim 16, wherein igniting the respective solid gas generant composition of at least one gas generator of the plurality of gas generators and the respective solid gas generant composition of at least one other gas generator of the plurality of gas generators in a predetermined time-based sequence further includes igniting the solid gas generant composition of a first gas generator at a first time and sequentially igniting the solid gas generant compositions of remaining gas generators of the plurality of gas generators at approximately 1.5 to approximately 2.5 second intervals subsequent the first time.

18. The method according to claim 16, further comprising providing the solid gas generant as a composition including hexa(ammine)cobalt(III)-nitrate (HACN).

19. The method according to claim 18, further comprising providing the solid gas generant composition as a composition including less than approximately 0.1% charcoal.

20. The method according to claim 19, further comprising providing the HACN as unrecrystallized HACN.

21. The method according to claim 20, further comprising providing the solid gas generant composition as a composition including cuprous oxide ($Cu_2O$) and a polyacrylamide binder.

22. The method according to claim 21, further comprising providing the solid gas generant composition as a composition including a plurality of chopped fibers.

23. The method according to claim 22, further comprising forming the solid gas generant composition of each gas generator as a plurality of stacked pellets.

24. The method according to claim 23, further comprising defining an air gap between adjacent pellets of the plurality of stacked pellets.

25. The method according to claim 24, wherein defining an air gap includes forming at least one surface feature in an end surface of each of the plurality of pellets.

26. The method of claim 16, further comprising arranging the plurality of gas generators within the defined space.

27. The method of claim 16, further comprising providing substantially the same solid gas generant composition and substantially the same quantity of solid gas generant to each of the plurality of gas generators.

28. The method of claim 26, further comprising distributing the plurality of gas generators in a spatial pattern within the defined space.

29. The method of claim 26, further comprising reducing the percentage of $O_2$ within the defined space at a predetermined rate and maintaining the reduced percentage of $O_2$ within the defined space to a predetermined range at least until the fire is suppressed.

30. The method of claim 29, wherein maintaining the reduced percentage of $O_2$ within the defined space to a predetermined range at least until the fire is suppressed comprises maintaining the reduced percentage of $O_2$ within the defined space at a range of from about 10% to about 20% at least until the fire is suppressed.

31. The method of claim 29, wherein maintaining the reduced percentage of $O_2$ within the defined space to a predetermined range at least until the fire is suppressed comprises maintaining the reduced percentage of $O_2$ within the defined space at a range of from about 13% to about 17% at least until the fire is suppressed.

32. A fire suppression system comprising:

a plurality of gas generators positioned within a defined space where a fire is to be suppressed, each gas generator of the plurality of gas generators having a solid gas generant composition positioned within a combustion chamber separate from any other combustion chamber of any other gas generator of the plurality of gas generators, each combustion chamber having a separate pressure controlling orifice from any other combustion chamber of any other gas generator, and each gas generator of the plurality of gas generators configured to generate a flow of gas into the defined space upon ignition of its respective solid gas generant composition; and at least one initiating device configured to ignite each of the respective solid gas generant compositions of each gas generator of the plurality of gas generators, and to ignite the respective solid gas generant composition of at least one gas generator of the plurality of gas generators independent of ignition of the respective solid gas generant composition of at least one other gas generator of the plurality of gas generators in a predetermined, time-ordered sequence selected to achieve and substantially maintain pressure within a predetermined range within the defined space during gas generation during ignition of the at least one gas generator and the at least one other gas generator of the plurality of gas generators.

* * * * *